US009769582B1

(12) United States Patent
Lin

(10) Patent No.: US 9,769,582 B1
(45) Date of Patent: Sep. 19, 2017

(54) AUDIO SOURCE AND AUDIO SENSOR TESTING

(71) Applicant: Amazon Technologies, Inc., Seattle, WA (US)

(72) Inventor: XiaoBin Lin, Guangzhou (CN)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 15/226,443

(22) Filed: Aug. 2, 2016

(51) Int. Cl.
*H04R 29/00* (2006.01)
*H04R 1/02* (2006.01)

(52) U.S. Cl.
CPC ..... *H04R 29/006* (2013.01); *H04R 1/02* (2013.01); *H04R 29/008* (2013.01)

(58) Field of Classification Search
CPC ..... H04R 29/004; H04R 3/00; H04R 3/005; H04R 3/04; H04R 2410/01; H04R 2430/21; H04R 25/50; H04R 29/002; H04R 29/007; H04S 7/307; G01H 7/00
See application file for complete search history.

(56) References Cited

U.S. PATENT DOCUMENTS 6,386,039 B1 * 5/2002 Peters ..... G01H 7/00 381/328
6,760,451 B1 * 7/2004 Craven ..... H03G 5/005 381/59
9,640,179 B1 * 5/2017 Hart ..... G10L 15/20
2001/0038702 A1 * 11/2001 Lavoie ..... H04S 7/301 381/307
2005/0063552 A1 * 3/2005 Shuttleworth ..... H03G 3/32 381/57
2006/0013407 A1 * 1/2006 Peavey ..... H04R 3/00 381/56
2010/0272270 A1 * 10/2010 Chaikin ..... H04R 29/008 381/59
2017/0127206 A1 * 5/2017 Skovenborg ..... H04R 29/002

* cited by examiner

*Primary Examiner* — Mohammad Islam
(74) *Attorney, Agent, or Firm* — Lee & Hayes, PLLC

(57) ABSTRACT

An example method includes controlling an audio source to generate a test tone, controlling a plurality of audio sensors to sense the test tone simultaneously, receiving an output signal from each audio sensor, and determining an acoustic characteristic of each audio sensor based at least in part on the received output signals. The method also includes determining a difference between the acoustic characteristic and a corresponding reference value, identifying at least one audio sensor for which a difference corresponding to the at least one audio sensor is within a predetermined range of the reference value, and generating a compensation factor of the at least one audio sensor based at least in part on the respective output signal of the at least one audio sensor.

20 Claims, 11 Drawing Sheets

AUDIO SOURCE AND AUDIO SENSOR TESTING

BACKGROUND

Electronic book readers, tablet computers, wireless telephones, laptop computers, and other electronic devices typically include one or more audio sensors, audio sources, and other components configured to enhance the user experience. Such audio components typically undergo a series of performance tests to ensure that they are capable of adequately performing various tasks associated with the use of the electronic device. For instance, manufacturers may test the frequency response and/or other acoustic characteristics of audio sensors to ensure that such audio sensors are suitable for use in the respective electronic devices. Additionally, manufacturers may test the total harmonic distortion and/or other acoustic characteristics of various audio sources to ensure that such audio sources are also suitable for use in the electronic devices. However, it may be difficult for known testing systems to determine such acoustic characteristics with sufficient accuracy and/or efficiency.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1:
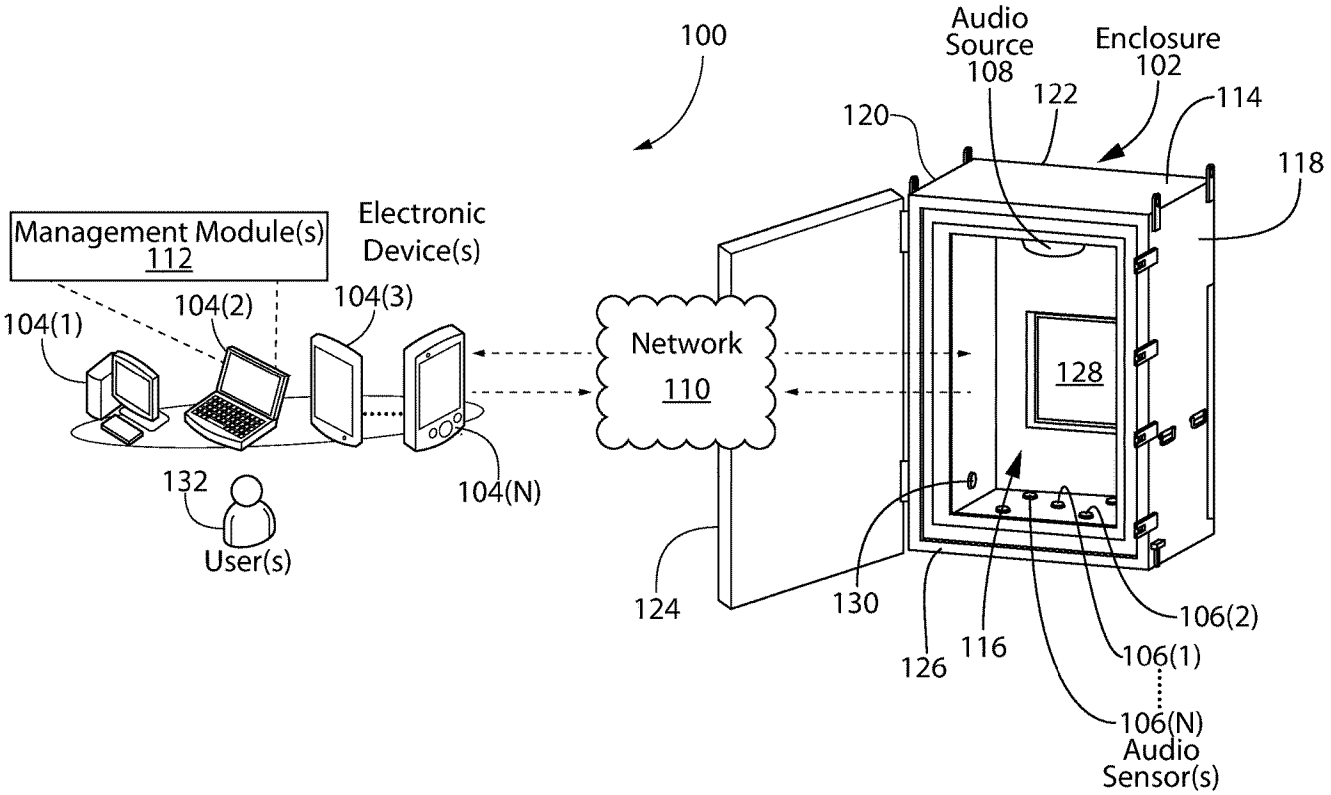
FIG. 1 illustrates an example system for testing audio sensors and/or audio sources.

Described herein are systems and methods for testing and/or calibrating audio components, such as audio sensors and audio sources. In example embodiments of the present disclosure, an audio source of a testing system may be employed to generate a test tone. An audio sensor used with such systems may be configured to sense the test tone, and one or more additional system components in communication with the audio sensor may be configured to determine an acoustic characteristic of at least one of the audio sensor and the audio source based on a signal received from the audio sensor. Components of the systems described herein may also be used to determine a compensation factor associated with the audio sensor and/or with the audio source. As a result, the example systems of the present disclosure may facilitate calibrating various audio sensors and/or audio sources for use in electronic devices based on the determined compensation factors.

In a first example, a system of the present disclosure may include a substantially soundproof enclosure, one or more audio sources disposed within an internal space of the enclosure, and one or more audio sensors disposed within the internal space and opposite the one or more audio sources. Such a system may also include one or more electronic devices operably connected to the one or more audio sources and the one or more audio sensors. For example, in embodiments configured for testing and/or calibrating audio sensors, the system may include a plurality of audio sensors disposed in an array within the internal space and configured to sense the test tone emitted by at least one audio source. Alternatively, in embodiments configured for testing and/or calibrating audio sources, the system may include two or more audio sources configured to emit sound waves in concert (e.g., substantially simultaneously). In such examples, the respective sound waves emitted by the two or more audio sources may combine to form a multi-frequency test tone, and the system may further include at least one audio sensor disposed within the internal space configured to sense the test tone.

Accordingly, in such audio sensor testing and/or calibration embodiments, a processor of an electronic device may control the audio source to generate a test tone within the enclosure. The processor may also control the plurality of audio sensors disposed within the enclosure to sense the test tone emitted by the audio source. Each of the audio sensors may generate a respective output signal indicative of the sensed test tone. For example, each output signal may be indicative of a frequency response of a respective audio sensor in response to and/or otherwise corresponding to the test tone. The processor may determine, based at least in part on the received output signals, an acoustic characteristic of each respective audio sensor. For example, in some embodiments the audio sensors described herein may comprise one or more microphones. In such examples, each microphone may direct an output signal to the processor indicative of the test tone. The processor may utilize such output signals in determining a sensitivity, a total harmonic distortion, and/or any other acoustic characteristic of the respective microphones.

The processor may also determine, for each audio sensor, a difference between the determined acoustic characteristic and a corresponding acoustic characteristic reference value. For example, the processor may compare the acoustic characteristic to a corresponding reference value, and may determine whether the difference between the determined acoustic characteristic and the reference value is within an acceptable range. In some examples, the differences described herein may be determined multiple times, for each audio sensor, across a range of test tone frequencies. The processor may also identify at least one audio sensor included in the audio sensor array for which a respective difference corresponding to the sensor is within the desired acceptable range of the reference value, and may generate a compensation factor corresponding to the identified sensor.

In such examples, the compensation factor may be generated based at least in part on the respective output signal of the audio sensor, the respective output signals of the remaining audio sensors in the array, and/or any other information received by the electronic device, and/or stored in a memory associated with the electronic device. In such examples, the compensation factor determined by the processor may be utilized as an offset and/or other like value when calibrating the corresponding audio sensor for use in an electronic device.

In embodiments configured for testing and/or calibrating audio sources, on the other hand, a processor of an electronic device may control two or more audio sources to generate a test tone within the enclosure. The processor may also control an audio sensor disposed within the enclosure to sense the test tone emitted by the audio sources. The audio sensor may generate an output signal indicative of the sensed test tone, and the output signal may be indicative of a frequency response of the audio sensor in response to and/or otherwise corresponding to the test tone. The processor may determine, based at least in part on the output signal, an acoustic characteristic of each respective audio source. For example, in some embodiments the audio sources described herein may comprise one or more speakers tailored to generate sound waves in different, and perhaps overlapping, frequency ranges. In such examples, each speaker may generate a respective sound wave in response to a command signal from the processor, and together, the sound waves may form the test tone described herein. The audio sensor may sense the test tone, and may direct an output signal to the processor indicative of the test tone. The processor may utilize such an output signal to determine a total harmonic distortion, a decibel level, a rub and buzz, and/or any other acoustic characteristic of the respective audio sources.

The processor may also determine, for each audio source, a difference between the determined acoustic characteristic, and a corresponding acoustic characteristic reference value. In some examples, the differences described herein may be determined multiple times, for each audio source, across a range of test tone frequencies. In some examples, the processor may identify at least one audio source having a respective difference (or a number of respective differences) outside of an acceptable range of the reference value, and may send an alarm to a user of the system, and/or may otherwise identify such an audio source as potentially being damaged or faulty. The processor may also identify at least one audio source for which a respective difference corresponding to the audio source is within the desired acceptable range of the reference value, and may generate a compensation factor corresponding to the identified audio source. In such examples, the compensation factor may be generated based at least in part on the output signal of the audio sensor, and/or any other information received by the electronic device and/or stored in a memory associated with the electronic device. In such examples, a compensation factor determined by the processor may be utilized as an offset and/or other like value when calibrating a corresponding audio source for use in an electronic device.

Since the various examples described herein provide systems and methods for testing and/or calibrating various audio sensors and audio sources, embodiments of the present disclosure may assist in improving the quality, reliability, and performance of electronic devices incorporating such audio devices and may, thus, increase user satisfaction. In particular, such methods enable users to test multiple audio sources simultaneously using a single test tone. Such methods also enable users to test multiple audio sources simultaneously. Additionally, such methods enable the use of a resulting compensation factor for digital, substantially-real time modifications to the operation of audio sensors and audio sources in a multitude of electronic devices. Such capabilities solve needs that are not currently met by existing systems or methods.

FIG. 1 illustrates an example system 100 of the present disclosure. The example system 100 of FIG. 1 may include, among other things, an enclosure 102, one or more electronic devices 104(1), 104(2), 104(3) . . . 104(N) (referred to collectively herein as "electronic devices 104" or singularly as "electronic device 104"), one or more audio sensors 106(1), 106(2) . . . 106(N) (referred to collectively herein as "audio sensors 106" or singularly as "audio sensor 106"), and one or more audio sources 108. As shown schematically in FIG. 1, one or more of the electronic devices 104 may be in communication with, and/or otherwise connected to the enclosure 102 and/or one or more components therein via one or more networks 110. Additionally or alternatively, one or more of the electronic devices 104 may be in communication with, and/or otherwise connected to the various components of the system 100, via one or more wired and/or other direct connections. In particular, as will be described in greater detail below, an electronic device 104 of the present disclosure may include a processor, memory, and/or additional components. In such examples, the memory may include one or more management modules 112 configured to assist in controlling operation of the various audio sensors 106, audio sources 108, and/or other components of the system 100. Additionally, in such examples, one or more of the management modules 112 may be in communication with the various components of the system 100 via the network 110 and/or via one of the other connections described herein.

In example embodiments, the enclosure 102 may comprise a substantially box-like structure including a top 114, a base 116 opposite the top 114, and a plurality of side walls 118, 120 extending from the top 114 to the base 116. The enclosure 102 may also include a back wall 122 and a front wall 124 opposite the back wall 122. In some examples, the front wall 124 may be hingedly, movably, removably, and/or otherwise connected to at least one of the sidewalls 118, 120 and/or to at least one of the top 114 and the base 116. In some examples, the front wall 124 may comprise a door or other like component that may be opened in order to insert items into a substantially enclosed internal space 126 of the enclosure 102, and to remove items from the internal space 126. At least one of the top 114, base 116, sidewall 118, sidewall 120, back wall 122, and front wall 124 may form at least part of the internal space 126. In some examples, each of these components of the enclosure 102 may combine to form the substantially enclosed internal space 126.

In some examples, the enclosure 102 may further include at least one door 128. The door 128 may be hingedly, movably, removably, and/or otherwise connected to at least one of the top 114, base 116, sidewall 118, sidewall 120, back wall 122, and front wall 124, and the door 128 may form at least part of the internal space 126. In such examples, the door 128 may comprise any component that may be opened in order to insert items into the internal space 126 of the enclosure 102, and to remove items from the internal space 126. In some examples, the door 128 may comprise a slidable window-like structure that may be moved between an open position and a closed position to provide access to the internal space 126. For example, in embodiments in which the front wall 124 comprises a door of the enclosure 102 that may be transitioned between an open position (shown in FIG. 1) and a closed position (not shown) in which the front wall 124 mates with the top 114, base 116, and sidewalls 118, 120, the door 128 may provide access to the internal space 126 while the front wall 124 is in the closed position.

The top 114, base 116, sidewalls 118, 120, back wall 122, front wall 124, and/or other components of the enclosure 102 may be made from steel, aluminum, plastic, alloys, composites, and/or any other substantially rigid material. Additionally, one or more surfaces of the top 114, base 116, sidewalls 118, 120, back wall 122, and front wall 124 may be covered with foam, cloth, and/or other sound damping material (not shown). Such material may, for example, substantially prohibit soundwaves beneath a threshold volume and/or frequency level from entering the internal space 126 of the enclosure 102 while the front wall 124 is in the closed position. Such material may also substantially prohibit soundwaves beneath a threshold volume and/or frequency level from exiting the internal space 126 of the enclosure 102 while the front wall 124 is in the closed position. In such examples, the enclosure 102 may comprise a substantially soundproof enclosure configured to assist testing the various audio sensors 106, audio sources 108, and/or other components described herein.

In some examples, the top 114, the sidewalls 118, 120, back wall 122, and/or other components of the enclosure 102 may include one or more openings or other such passages 130. Such passages 130 may allow components of the system 100 external to the enclosure 102 to be mechanically, electrically, operably, and/or otherwise connected to the sensors 106, audio sources 108, and/or other components of the system 100 disposed within the enclosure 102. In such examples, additional sound damping material (not shown) may be provided in, around, and/or proximate such passages 130 to assist in substantially prohibiting soundwaves beneath a threshold volume and/or frequency level from entering or exiting the internal space 126 via the passages 130.

The audio sensors 106 of the present disclosure may comprise any acoustic device, and/or other mechanism configured to sense, and/or otherwise detect soundwaves. In some examples, one or more of the audio sensors 106 may comprise a microphone configured to sense and/or otherwise determine a test tone generated by the audio source 108. Additionally, the audio source 108 may comprise one or more woofers, tweeters, speakers, and/or other acoustic devices or mechanisms configured to emit sound waves. In such examples, the audio sensors 106 described herein may comprise a plurality of microphones disposed within the internal space 126 and configured to sense the test tone substantially simultaneously. As will be described below, in some examples, two or more of the audio sensors 106 may be disposed within and/or along a common plane within the internal space 126. Additionally or alternatively, two or more of the audio sensors 106 may be disposed along a common axis, within the internal space 126. In any of the examples described herein, the audio sensors 106 may comprise an array of microphones configured to sense and/or otherwise determine the test tone generated by the audio source 108.

The network 110 illustrated in FIG. 1 may be a local area network ("LAN"), a larger network such as a wide area network ("WAN"), or a collection of networks, such as the Internet. Protocols for network communication, such as TCP/IP, may be used to implement the network 110. Although embodiments may be described herein as using a network 110 such as the Internet, other distribution techniques may also be implemented to transmit information between the electronic devices and the audio sensors 106, audio sources 108, and/or other components of the system 100. Such distribution techniques may include, for example, the transfer of signals, files, information and/or other electronic or digital content via memory cards, flash memory, or other portable memory devices.

In various embodiments, the electronic devices 104 may include a server computer, a desktop computer, a portable computer (e.g., a laptop computer), a mobile phone, a tablet computer, or other electronic computing devices. Each of the electronic devices 104 may have software and hardware components that enable various functions of the electronic devices 104 during use. For example, as will be described in greater detail below, each of the electronic devices 104 may include one or more processors, I/O interfaces, I/O devices, communication interfaces, memory, and/or other components configured to assist in controlling operation of various components of the system 100. In particular, a memory of an electronic device 104 may include one or more management modules 112 comprising an operating system module, an audio sensor management module, an audio source management module, and/or other modules. One or more such modules and/or the memory, generally, may store instructions which, when executed by a processor or the electronic device 104, may cause the processor to perform various operations associated with the operation and/or control of various components of the system 100. The electronic devices 104 noted above are merely examples, and other electronic devices that are equipped with network communication components, data processing components, displays for displaying data, and components for controlling the operation of, for example, audio sensors and/or audio sources may also be employed by one or more users 132.

As noted above, the system 100 may include one or more audio sources 108 disposed within the internal space 126, and one or more audio sensors 106. For example, in embodiments associated with audio sensor testing and/or calibration, a plurality of audio sensors 106 may be disposed within the internal space 126. In such example embodiments, each audio sensor 106 of the plurality of audio sensors 106 may be configured to sense a test tone emitted by an audio source 108 disposed within the internal space 126 substantially simultaneously (e.g., at substantially the same time). Alternatively, in embodiments associated with audio source testing and/or calibration, a plurality of audio sources 108 may be disposed within the internal space 126. In such example embodiments, the plurality of audio sources 108 may be configured to generate a test tone in concert. In particular, each audio source 108 of the plurality of audio sources 108 may be substantially simultaneously driven to generate respective sound waves. Together, the sound waves emitted by the plurality of audio sources 108 may comprise the test tone (e.g., a composite sound wave having a range of frequencies), and such a test tone may be sensed by one or more audio sensors 106 disposed within the internal space. It is understood that in additional embodiments, such a test tone may also be generated by a single audio source 108.

Figure 2:
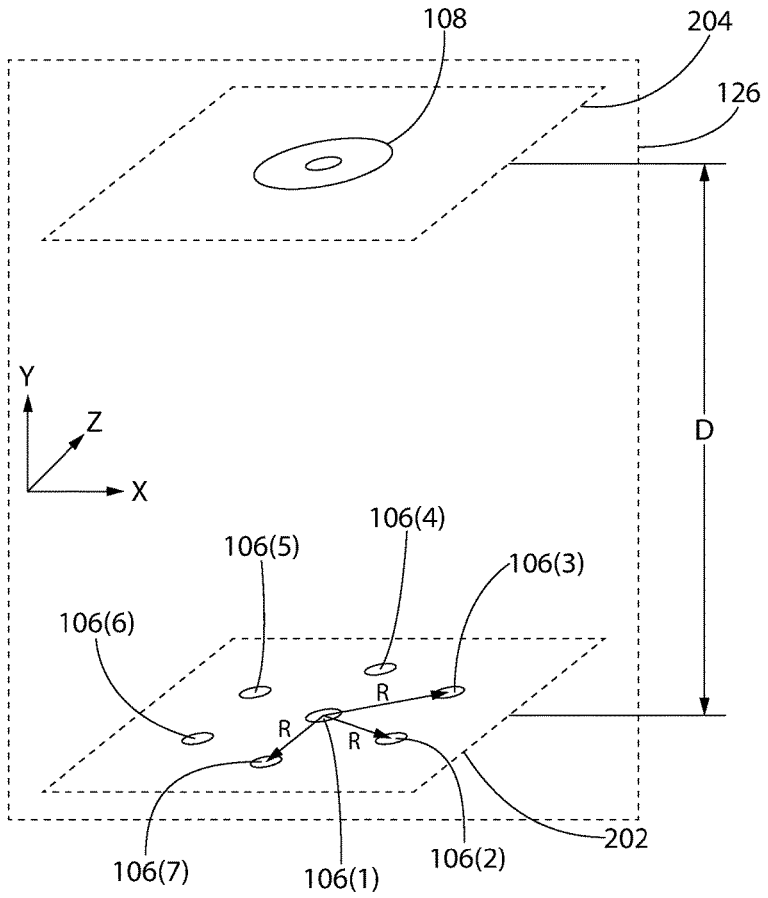
FIG. 2 illustrates an example arrangement of audio sensors relative to an audio source.

In any of the example embodiments described herein, the audio sensors 106 and/or the audio sources 108 may be disposed and/or otherwise positioned in an array within the internal space 126. FIGS. 2-7 illustrate example arrays that may be utilized in various embodiments of the present disclosure. For example, FIG. 2 illustrates an embodiment including a plurality of audio sources 106 disposed in a common first plane 202 within the internal space 126. The embodiment illustrated in FIG. 2 also includes an audio source 108 disposed in a second plane 204 spaced (e.g., vertically or horizontally) from the first plane 202 by a distance D. In such examples, the first plane 202 may be disposed substantially parallel to the second plane 204. In additional embodiments, however, the first plane 202 may be disposed substantially perpendicular to the second plane 204, and/or at any other desired included angle within the internal space 126. Additionally, the distance D may have any value desirable for maximizing the accuracy and/or efficiency of testing the audio sensors 106 and/or the audio source 108. For example, in some embodiments, the distance D may be between approximately 10 cm and approximately 40 cm. In further examples, the distance D may be between approximately 20 cm and approximately 30 cm. In still further examples, the distance D may be any value greater than or less than 10 cm.

In the example embodiment illustrated in FIG. 2, the plurality of audio sensors 106 may be disposed in a substantially circular array. For example, the plurality of audio sensors 106 may include a first audio sensor 106(1) disposed substantially centrally in such an array. The plurality of audio sensors 106 may also include any number of additional audio sensors (e.g., a remainder of audio sensors) 106(N) spaced radially from the first sensor 106(1), in the common first plane 202, by a common radial distance R. The distance R may have any value desirable for maximizing the accuracy and/or efficiency of testing the audio sensors 106, and/or the audio source 108. For example, in some embodiments the distance R may be between approximately 10 cm and approximately 30 cm. In further examples, the distance R may be between approximately 10 cm and approximately 20 cm. In still further examples, the distance R may be any value greater than or less than 10 cm. Additionally, while FIG. 2 illustrates an embodiment in which the remainder of audio sensors 106 of the plurality of audio sensors are substantially evenly spaced circumferentially about the central first audio sensor 106(1), in additional circular array embodiments the plurality of audio sensors 106 may have any desired angular (e.g., radial) spacing, in the first plane 202, about a central point in the first plane 202. Additionally, in some circular array embodiments the central first audio sensor 106(1) may be omitted. In any of the example embodiments described herein, the various audio sensor arrays may include any number of audio sensors 106 desired for substantially simultaneously sensing a test tone emitted from one or more audio sources 108 within the internal space 126. For example, although FIG. 2 illustrates a total of seven audio sensors 106, in further example embodiments, greater than or less than seven audio sensors 106 may be utilized in the various audio sensor arrays of the present disclosure.

Figure 3:
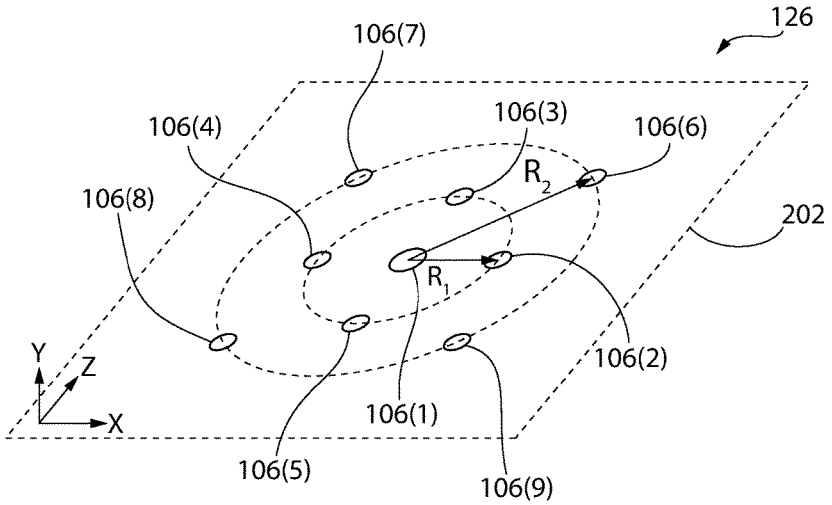
FIG. 3 illustrates another example arrangement of audio sensors.

FIG. 3 illustrates another example of a substantially circular array of the present disclosure. As shown in FIG. 3, in some examples the plurality of audio sensors 106 may include a first audio sensor 106(1) disposed substantially centrally in such an array. The plurality of audio sensors 106 may also include any number of additional audio sensors 106(N) spaced radially from the first sensor 106(1), in the common first plane 202, by a common radial distance $R_1$. For example, the plurality of audio sensors 106 may comprises a first group of audio sensors 106(2), 106(3), 106(4), 106(5) spaced radially from the first sensor 106(1), in the first plane 202, by a common first radial distance $R_1$, and a second group of audio sensors 106(6), 106(7), 106(8), 106(9) different from the first group of audio sensors 106(2), 106(3), 106(4), 106(5). The second group of audio sensors 106(6), 106(7), 106(8), 106(9) may be spaced radially from the first audio sensor 106(1), in the first plane 202, by a common second radial distance $R_2$ different from the first radial distance $R_1$.

In such circular array embodiments, the distances $R_1$, $R_2$ may have any respective value desirable for maximizing the accuracy and/or efficiency of testing the audio sensors 106, and/or the audio source 108. For example, in some embodiments, at least one of the distances $R_1$, $R_2$ may be between approximately 10 cm and approximately 30 cm. In further examples, at least one of the distances $R_1$, $R_2$ may be between approximately 10 cm and approximately 20 cm. In still further examples, at least one of the distances $R_1$, $R_2$ may be any value greater than or less than 10 cm. Additionally, while FIG. 3 illustrates an embodiment in which the first group of audio sensors 106(2), 106(3), 106(4), 106(5) and the second group of audio sensors 106(6), 106(7), 106(8), 106(9) are substantially evenly spaced, circumferentially about the central first audio sensor 106(1), in additional circular array embodiments, the plurality of audio sensors 106 in the first and second groups may have any desired angular (e.g., radial) spacing, in the first plane 202, about a central point in the first plane 202. Additionally, in some circular array embodiments the central first audio sensor 106(1) may be omitted. Further, although FIG. 3 illustrates a total of nine audio sensors 106, and two concentric rings (i.e., two groups) of audio sensors 106, in further example embodiments, greater than or less than nine audio sensors 106 may be utilized in the various audio sensor arrays of the present disclosure. Additionally, greater than or less than two concentric rings (i.e., two groups) of audio sensors 106 may be utilized in the various audio sensor arrays of the present disclosure.

Figure 4:
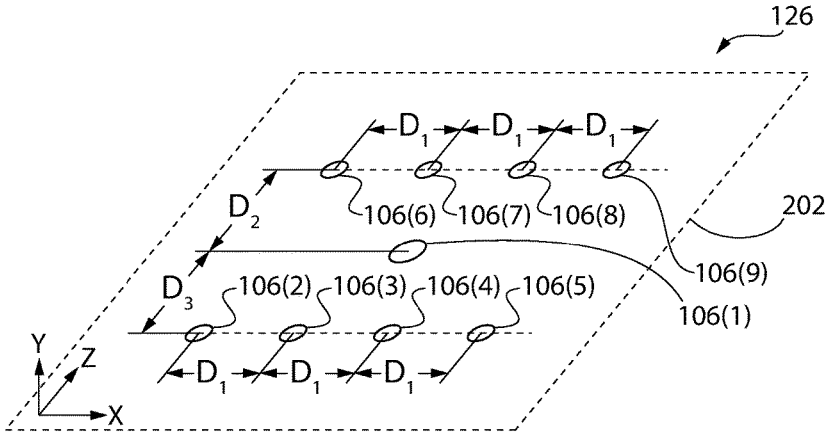
FIG. 4 illustrates still another example arrangement of audio sensors.

FIG. 4 illustrates an example of a substantially linear array of the present disclosure. As shown in FIG. 4, in some examples the plurality of audio sensors 106 may include a first audio sensor 106(1) disposed substantially centrally in such an array. The plurality of audio sensors 106 may also include any number of additional audio sensors 106(N) spaced linearly from one another along a common linear axis in the first plane 202. For example, the plurality of audio sensors 106 may include a first group of audio sensors 106(2), 106(3), 106(4), 106(5) spaced linearly from one another, in the first plane 202, along a common axis by a common distance $D_1$. The plurality of audio sensors 106 may also include a second group of audio sensors 106(6), 106(7), 106(8), 106(9) different from the first group of audio sensors 106(2), 106(3), 106(4), 106(5). The second group of audio sensors 106(6), 106(7), 106(8), 106(9) may also be spaced linearly from one another, in the first plane 202, along a common axis by a common distance $D_1$. In some examples, the spacing (e.g., distance $D_1$) between the respective audio sensors 106(2), 106(3), 106(4), 106(5) of the first group may be the same as the spacing (e.g., distance $D_1$) between the respective audio sensors 106(6), 106(7), 106(8), 106(9) of the second group. Alternatively, in further examples, the spacing between the respective audio sensors 106(2), 106(3), 106(4), 106(5) of the first group may be different from the spacing between the respective audio sensors 106(6), 106(7), 106(8), 106(9) of the second group. In still further examples, at least one audio sensor 106 of the first and second groups of audio sensors 106 may be spaced from an adjacent audio sensor along the common axis by a distance other than the common distance $D_1$. As shown in FIG. 4, in some examples the common axis of the first group of audio sensors 106(2), 106(3), 106(4), 106(5) may be spaced from the first audio sensor 106(1), in the first plane 202, by a second distance $D_2$, and the common axis of the second group of audio sensors 106(6), 106(7), 106(8), 106(9) may be spaced from the first audio sensor 106(1), in the first plane 202, by a third distance $D_3$. In some examples, the second distance $D_2$ may be equal to at least one of the first distance $D_1$ and the third distance $D_3$. Alternatively, in further examples, the second distance $D_2$ may be different from at least one of the first distance $D_1$ and the third distance $D_3$.

In such linear array embodiments, the distances $D_1$, $D_2$, $D_3$ may have any respective value desirable for maximizing the accuracy and/or efficiency of testing the audio sensors 106, and/or the audio source 108. For example, in some embodiments, at least one of the distances $D_1$, $D_2$, $D_3$ may be between approximately 10 cm and approximately 30 cm. In further examples, at least one of the distances $D_1$, $D_2$, $D_3$ may be between approximately 10 cm and approximately 20 cm. In still further examples, at least one of the distances $D_1$, $D_2$, $D_3$ may be any value greater than or less than 10 cm. Additionally, in some linear array embodiments the central first audio sensor 106(1) may be omitted. Further, although FIG. 4 illustrates a total of nine audio sensors 106, and two groups of audio sensors 106, in further example embodiments, greater than or less than nine audio sensors 106 may be utilized in the various linear audio sensor arrays of the present disclosure. Additionally, greater than or less than two groups of audio sensors 106 may be utilized in the various linear audio sensor arrays of the present disclosure.

Figure 4A:
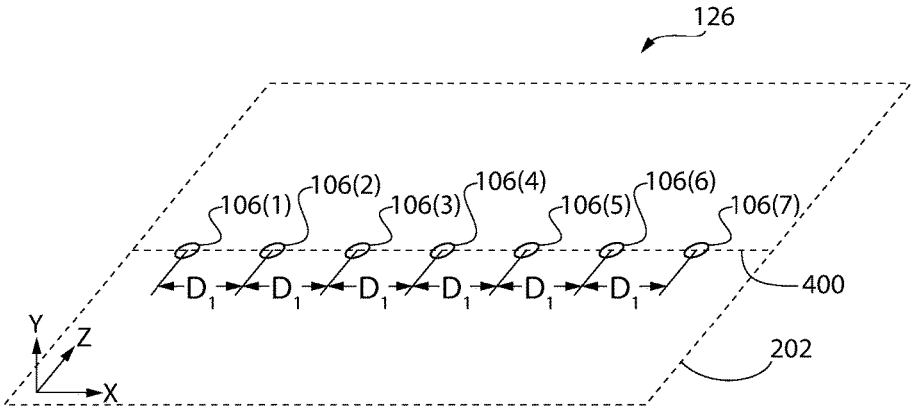
FIG. 4*a* illustrates another example arrangement of audio sensors.

FIG. 4*a* illustrates another example of a substantially linear array of the present disclosure. While FIG. 4*a* illustrates an array including seven audio sensors 106 disposed along a common linear axis 400, in further examples, such an array may include any number of audio sensors greater than or less than seven. In such example linear arrays the audio sensors 106 may be spaced linearly from one another along the axis 400 in the first plane 202. For example, the plurality of audio sensors 106 may include audio sensors 106(1), 106(2), 106(3), 106(4), 106(5), 106(6), 106(7) spaced linearly from one another, in the first plane 202, along the axis 400 by a common distance $D_1$. In still further examples, at least one audio sensor 106 of the plurality of audio sensors may be spaced from an adjacent audio sensor along the axis 400 by a distance other than the common distance $D_1$. In such linear array embodiments, the distance $D_1$ may have any value desirable for maximizing the accuracy and/or efficiency of testing the audio sensors 106, and/or the audio source 108. For example, in some embodiments the distance $D_1$ may be between approximately 10 cm and approximately 30 cm. In further examples, the distance $D_1$ may be between approximately 10 cm and approximately 20 cm. In still further examples, the distance $D_1$ may be any value greater than or less than 10 cm.

Figure 5:
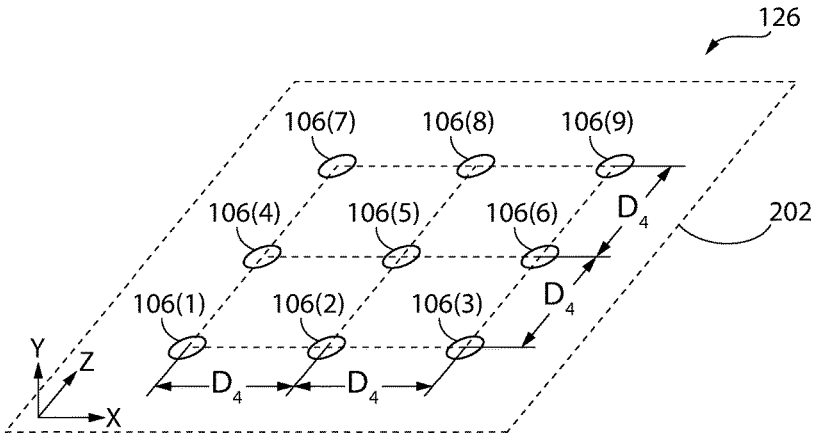
FIG. 5 illustrates a further example arrangement of audio sensors.

FIG. 5 illustrates an example of a substantially planar array of the present disclosure. As shown in FIG. 5, in some examples the plurality of audio sensors 106 may include any number of audio sensors 106(N) spaced linearly from one another along respective linear axes in the first plane 202. For example, the plurality of audio sensors 106 may include a first group of audio sensors 106(1), 106(2), 106(3) spaced linearly from one another, in the first plane 202, along a common axis by a common distance $D_4$. The plurality of audio sensors 106 may also include a second group of audio sensors 106(4), 106(5), 106(6) different from the first group of audio sensors 106(1), 106(2), 106(3). The second group of audio sensors 106(4), 106(5), 106(6) may also be spaced linearly from one another, in the first plane 202, along a common axis by a common distance $D_4$. In some examples, the spacing (e.g., distance $D_4$) between the respective audio sensors 106(1), 106(2), 106(3) of the first group may be the same as the spacing (e.g., distance $D_4$) between the respective audio sensors 106(4), 106(5), 106(6) of the second group. Alternatively, in further examples, the spacing between the respective audio sensors 106(1), 106(2), 106(3) of the first group may be different from the spacing between the respective audio sensors 106(4), 106(5), 106(6) of the second group. In still further examples, at least one audio sensor 106 of the first and second groups of audio sensors 106 may be spaced from an adjacent audio sensor 106, along the common axis, by a distance other than the common distance $D_4$. As shown in FIG. 5, in some examples the common axis of the first group of audio sensors 106(1), 106(2), 106(3) may be spaced from the common axis of the second group of audio sensors 106(4), 106(5), 106(6), in the first plane 202, by the distance $D_4$. Alternatively, in further examples, the common axis of the first group of audio sensors 106(1), 106(2), 106(3) may be spaced from the common axis of the second group of audio sensors 106(4), 106(5), 106(6), in the first plane 202, by any distance other than the distance $D_4$.

As shown in FIG. 5, the plurality of audio sensors 106 may also include a third group of audio sensors 106(7), 106(8), 106(9) different from the first second groups of audio sensors. The respective audio sensors 106(7), 106(8), 106(9) of third group of audio sensors may also be spaced linearly from one another, in the first plane 202, along a common axis by a common distance $D_4$. In some examples, the spacing (e.g., distance $D_4$) between the respective audio sensors 106(7), 106(8), 106(9) of the third group may be the same as the spacing between the respective audio sensors 106(1), 106(2), 106(3) of the first group, and the same as the spacing between the respective audio sensors 106(4), 106(5), 106(6) of the second group. Alternatively, in further examples, the spacing between the respective audio sensors 106(7), 106(8), 106(9) of the third group may be different from the spacing between the respective audio sensors 106 of at least one of the second and third groups. In still further examples, at least one audio sensor 106 of the first and second groups of audio sensors 106 may be spaced from an adjacent audio sensor along the common axis by a distance other than the common distance $D_4$.

In such planar array embodiments, the distances $D_4$ may have any respective value desirable for maximizing the accuracy and/or efficiency of testing the audio sensors 106, and/or the audio source 108. For example, in some embodiments, at least one of the distances $D_4$ may be between approximately 10 cm and approximately 30 cm. In further examples, at least one of the distances $D_4$ may be between approximately 10 cm and approximately 20 cm. In still further examples, at least one of the distances $D_4$ may be any value greater than or less than 10 cm. Additionally, in some planar array embodiments a central audio sensor 106(5) may be omitted. Further, although FIG. 5 illustrates a total of nine audio sensors 106, and three groups of audio sensors 106, in further example embodiments, greater than or less than nine audio sensors 106 may be utilized in the various planar audio sensor arrays of the present disclosure. Additionally, greater than or less than three groups of audio sensors 106 may be utilized in the various planar audio sensor arrays of the present disclosure.

Figure 6:
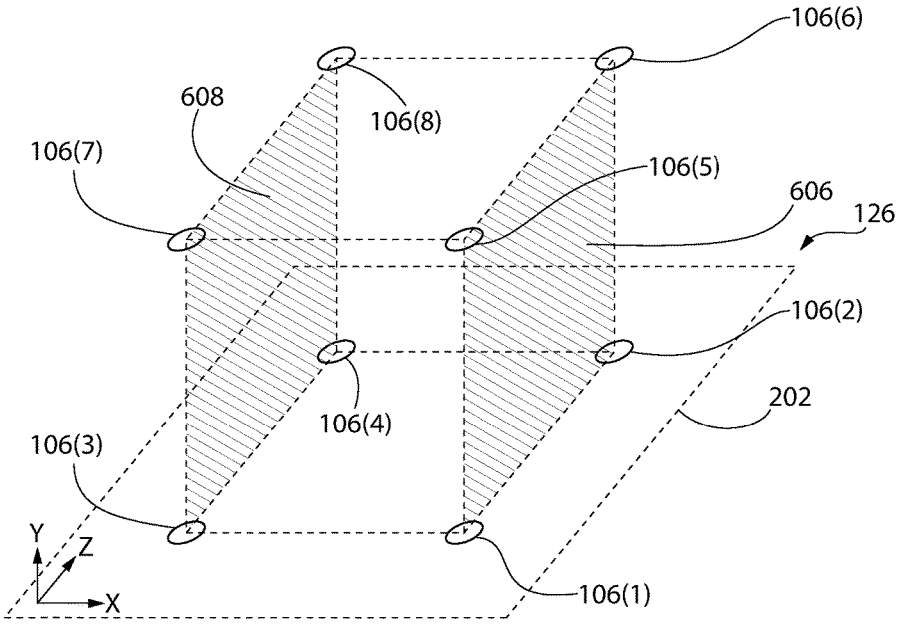
FIG. 6 illustrates yet another example arrangement of audio sensors.

FIG. 6 illustrates an example three-dimensional array of the present disclosure. As shown in FIG. 6, in some examples a plurality of audio sensors 106 may include any number of audio sensors 106(N) spaced from one another, and such audio sensors 106(N) may be disposed in two or more planes within the internal space 126. For example, the plurality of audio sensors 106 may include a first group of audio sensors 106(1), 106(2), 106(3), 106(4) spaced from one another, linearly, radially, or otherwise, in a first plane 602. In some examples, the first plane 602 may be disposed substantially parallel to and/or coplanar with the first plane 202 described above. The plurality of audio sensors 106 may also include a second group of audio sensors 106(5), 106(6), 106(7), 106(8) different from the first group of audio sensors 106(1), 106(2), 106(3), 106(4). The second group of audio sensors 106(5), 106(6), 106(7), 106(8) may also be spaced from one another, linearly, radially, or otherwise, in a second plane 604. As shown in FIG. 6, the second plane 604 may be spaced vertically (e.g., along the Y-axis) from the first plane 602 and, in some examples, the second plane 604 may be disposed substantially parallel to the first plane 602. In some example three-dimensional arrays, the audio sensors 106(1), 106(2), 106(5), 106(6) may also be spaced from one another, linearly, radially, or otherwise, in a third plane 606. Such an example third plane 604 may be disposed substantially perpendicular to the first plane 602 and/or the second plane 604. Further, in example three-dimensional arrays the audio sensors 106(3), 106(4), 106(7), 106(8) may also be spaced from one another, linearly, radially, or otherwise, in a fourth plane 608. Such an example fourth plane 608 may be disposed substantially perpendicular to the first plane 602 and/or the second plane 604. Additionally, such an example fourth plane 608 may be spaced horizontally (e.g., along the X-axis) from the third plane 606. Although FIG. 6 illustrates a total of eight audio sensors 106, in further example embodiments, greater than or less than eight audio sensors 106 may be utilized in the various three-dimensional audio sensor arrays of the present disclosure. Additionally, although FIG. 6 illustrates a substantially cube-shaped arrangement of audio sensors 106, in further example three-dimensional arrays of the present disclosure, the plurality of audio sensors 106 may be arranged in any other three dimensional shape such as a pyramid, a sphere, a rhombus-shaped cube, a rectangle-shaped cube, etc.

Figure 7:
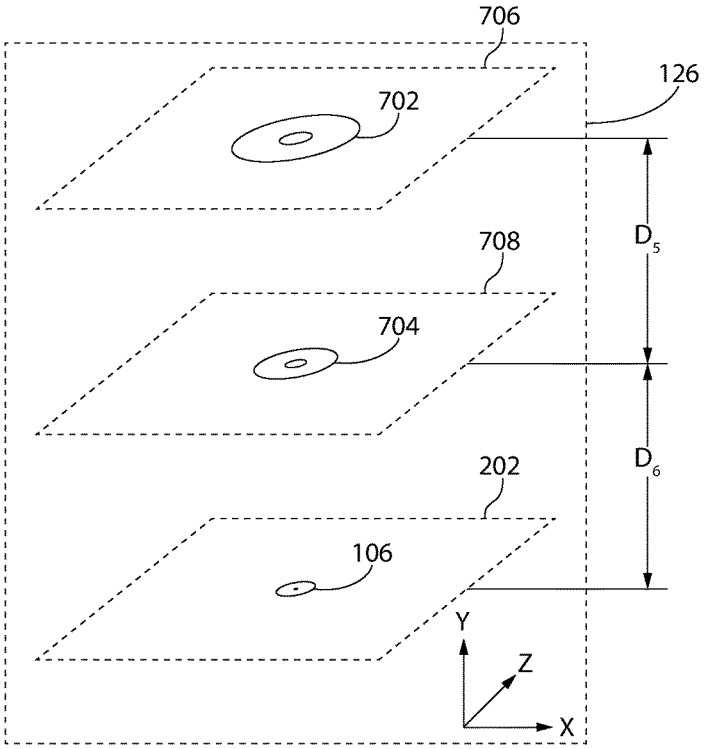
FIG. 7 illustrates an example arrangement of an audio sensor relative to first and second audio sources.

FIG. 7 illustrates still another example embodiment of the present disclosure in which a plurality of audio sources are disposed within the internal space 126 with at least one audio sensor 106. Whereas the embodiments described herein with respect to FIGS. 2-6 may be used for testing and/or calibrating one or more audio sensors 106 of the present disclosure, the embodiment of FIG. 7 may be used for testing and/or calibrating one or more audio sources. As shown in FIG. 7, in some examples a first audio source 702 may be disposed within the internal space 126 and a second audio source 704 may be disposed within the internal space 126 spaced from the first audio source 702. Such embodiments may also include at least one audio sensor 106 disposed within the internal space 126 spaced from the first and second audio sources 702, 704. For example, the audio sensor 106 may be disposed in the first plane 202 described above, the first audio source 702 may be disposed within a second plane 706, and the second audio source 704 may be disposed within a third plane 708. The second plane 706 may be spaced vertically (e.g., along the Y-axis) from the third plane 708 by a distance $D_5$ and, in some examples, the second plane 706 may be disposed substantially parallel to at least one of the third plane 708 and the first plane 202. Additionally, third plane 708 may be spaced vertically (e.g., along the Y-axis) from the first plane 202 by a distance $D_6$ and, in some examples, the third plane 708 may be disposed substantially parallel to at least one of the second plane 706 and the first plane 202. Alternatively, in further examples, at least one of the planes 202, 706, 708 may be disposed substantially perpendicular to and/or at any other desired included angle relative to at least one of the other planes 202, 706, 708.

The distance $D_5$ may be selected to maximize the efficiency, accuracy, quality, and/or other parameters of a test tone generated by the audio sources 702, 704. For example, the audio sources 702, 704 may be configured to generate a test tone in concert. In particular, the audio sources 702, 704 may be substantially simultaneously driven to generate respective sound waves, and each respective sound wave may be characterized by a particular range of frequencies. Together, the sound waves emitted by the audio sources 702, 704 may comprise the test tone, and such a test tone may be sensed by the one or more audio sensors 106 disposed within the internal space 126. In some examples, the test tone frequency may be between approximately 80 Hz to approximately 10 kHz. In particular, the respective sound waves generated by the audio sources 702, 704 may combine to form a single test tone characterized by a frequency between approximately 80 Hz and approximately 10 kHz. In some examples, the audio sources 702, 704 may be controlled to increase a frequency of the test tone from approximately 80 Hz to approximately 10 kHz in increments of approximately 20 ms. It is understood that the various frequency ranges, time increments, and other characteristics of the test tones described herein are merely examples. In other embodiments, a frequency of the test tone may be less than approximately 80 Hz or greater than approximately 10 kHz, and the frequency, volume, and/or other parameters of the test tone may be varied in increments greater than or less than approximately 20 ms. Further, in order to generate the example test tones described herein in some embodiments the first audio source 702 may be tailored to emitting relatively low frequency sound waves while the second audio source 704 may be tailored to emitting relatively high frequency sound waves. In such examples, the audio sources 702, 704 may comprise one or more speakers, and the first audio source 702 may comprise a woofer while the second audio source 704 may comprise a tweeter.

With continued reference to FIG. 7, it is understood that the distances $D_5$, $D_6$ may have any respective value desirable for maximizing the accuracy and/or efficiency of testing the one or more audio sensors 106, and/or the audio sources 702, 704. For example, in some embodiments, at least one of the distances $D_5$, $D_6$ may be between approximately 10 cm and approximately 40 cm. In further examples, at least one of the distances $D_5$, $D_6$ may be between approximately 10 cm and approximately 20 cm. In still further examples, at least one of the distances $D_5$, $D_6$ may be any value greater than or less than 10 cm. Additionally, in some embodiments greater than or less than two audio sources 702, 704 may be utilized to generate a test tone within the internal space 126. In such examples, greater than two audio sources 702, 704 may be simultaneously tested and/or calibrated using the system 100.

Figure 8:
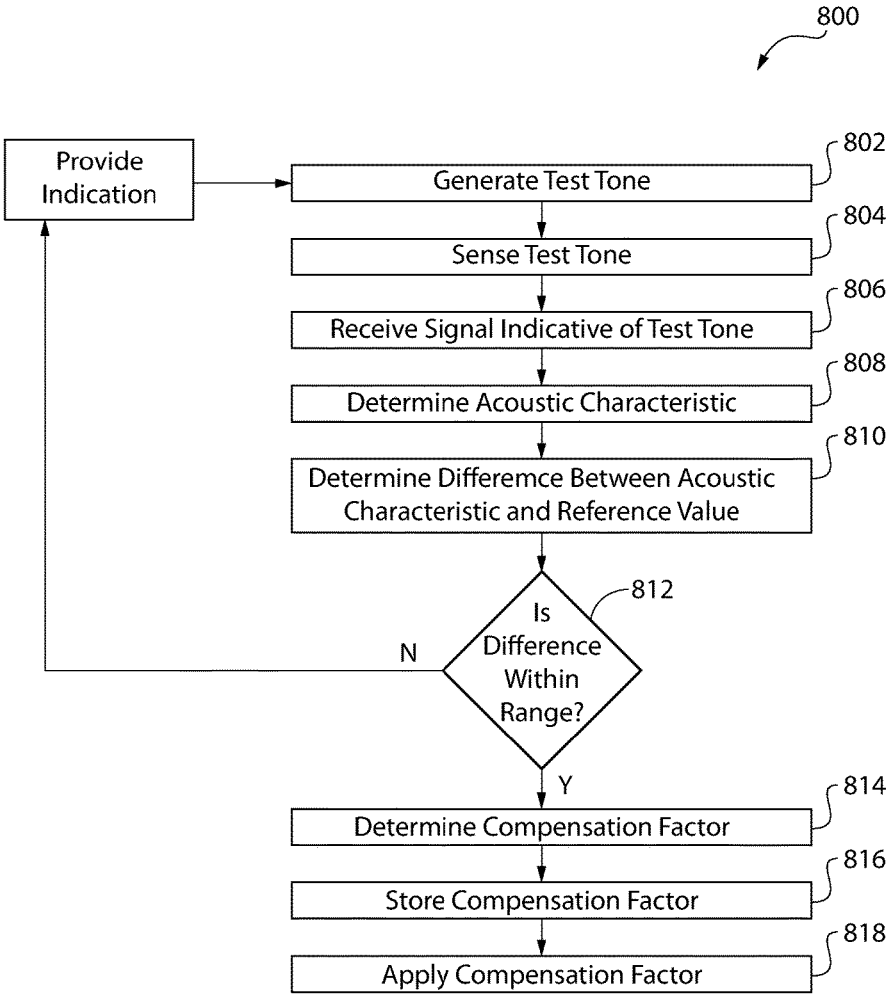
FIG. 8 is a flow diagram illustrating an example method of the present disclosure.

FIG. 8 illustrates a flow diagram of an example method 800 of the present disclosure. In some instances, the method 800, or portions thereof, may be repeated one or more times in order to assist in determining, for example, an acoustic characteristic of one or more audio sensors 106 and/or a compensation factor of one or more audio sensors 106. The example method 800 is illustrated as a collection of blocks in a logical flow diagram, which represent a sequence of operations, some or all of which can be implemented in hardware, software or a combination thereof. In the context of software, the blocks represent computer-executable instructions stored on one or more computer-readable media and/or other memory associated with an electronic device 104 of the present disclosure that, when executed by one or more processors of the electronic device 104, perform the recited operations. Generally, computer-executable instructions include routines, programs, objects, components, data structures and the like that perform particular functions or implement particular abstract data types. The order in which the operations are described should not be construed as a limitation. Any number of the described blocks can be combined in any order and/or in parallel to implement the process, or alternative processes, and not all of the blocks need be executed. For discussion purposes, the methods herein are described with reference to the system 100, audio sensor arrays, audio sources, frameworks, architectures, and environments described in the examples herein, although the methods may be implemented in a wide variety of other systems, frameworks, architectures, or environments.

The description of the various methods may include certain transitional language and directional language, such as "then," "next," "thereafter," "subsequently," "returning to," "continuing to," "proceeding to," etc. These words, and other similar words, are simply intended to guide the reader through the graphical illustrations of the methods and are not intended to limit the order in which the method steps depicted in the illustrations may be performed.

For ease of description, the method 800 will be described with respect to the system 100 of FIG. 1, and the audio source 108 and audio sensors 106 illustrated in FIGS. 1 and 2. For example, a system 100 configured to perform the operations associated with the method 800 may include at least one speaker and/or other audio source 108 disposed within a substantially soundproof enclosure 102. The system 100 may also include at least one microphone and/or other audio sensor 106 disposed within the enclosure 102. As noted above with respect to at least FIG. 2, in some examples, a plurality of such audio sensors 106, such as a circular array of audio sensors 106, may be positioned within the enclosure 102, and each audio sensor 106 may be disposed in a common plane 202 spaced from the audio source 108. For example, such an array of audio sensors 106 may include a first audio sensor 106(1) centrally disposed with respect to a remainder of audio sensors 106 such that, for example, a second audio sensor 106(2) is spaced from the first audio sensor 106(1) by a first distance R, and a third audio sensor 106(3) spaced from the first audio sensor 106(1) by the first distance R. As noted above, in some examples the first distance R may comprise a radial distance, and the remainder of audio sensors 106 disposed within the enclosure 102 may be spaced radially from the first microphone 106(1) by the first radial distance R. Alternatively, in additional examples, any of the linear arrays, planar arrays, circular arrays, and/or three-dimensional arrays of audio sensors 106 described herein may be used in association with the method 800.

Beginning at 802, the method 800 includes controlling, with a processor of at least one of the electronic devices 104, the audio source 108 to generate a test tone. As noted above, in some examples, the test tone may comprise a multi-frequency test tone generated by the audio source 108 for a predetermined length of time, and/or at a predetermined decibel level. In some examples, the frequency, decibel level, and/or other parameters of the test tone may remain constant during at least part of the method 800 illustrated in FIG. 8. Alternatively, in additional examples, one or more parameters of the test tone may change during at least part of the method 800. For example, in some embodiments, the processor of the electronic device 104 may control the audio source 108 to increase, and/or decrease the frequency of the test tone. In some examples, as noted above, the processor of the electronic device 104 may control the audio source 108 to increase a frequency of the test tone from approximately 80 Hz to approximately 10 kHz. In such examples, the processor may control the audio source 108 to increase the frequency of the test tone at a constant rate or incrementally. For example, the processor may control the audio source 108 to increase the frequency of the test tone in increments of approximately 1 Hz, 2 Hz, 5 Hz, 10 Hz, 20 Hz, and/or any other frequency increment. Additionally, the processor may control the audio source 108 to increase the frequency of the test tone in increments of approximately 1 ms, 2 ms, 5 ms, 10 ms, 20 ms, 100 ms, and/or any other time increment. Alternatively, in additional embodiments, other frequency ranges, decibel levels, and/or time increments may be utilized by the processor in order to produce variations in the test tone.

At 804, the processor of the electronic device 104 may control each audio sensor 106 of the plurality of audio sensors disposed within the enclosure 102 to sense, and/or otherwise determine the test tone generated by the audio source 108. At 804, the processor may control each audio sensor to determine the presence of the test tone within the internal space. Additionally or alternatively, the processor may control each audio sensor 106 to determine one or more parameters of the test tone. Such parameters may include, for example, one or more of a frequency, amplitude, time, duration, decibel level, bass level, treble level, presence level, and/or other acoustic parameter. Due to the configuration of the audio sensors 106 relative to the audio source 108, in some examples, each audio sensor 106 of the plurality of audio sensors, may sense the test tone substantially simultaneously. In particular, in examples in which each audio sensor 106 is disposed in a first plane 202 and the audio source 108 is disposed in a second plane 204 disposed substantially parallel to the first plane 202 within the internal space 126, the test tone generated by the audio source 108 (e.g., a sound wave emitted by the audio source 108) may reach each of the audio sensors 106 at substantially the same time. In this way, at 804, each audio sensor 106 may sense the test tone at substantially the same time for an entire time period (t) within which the test tone is generated. It is understood that in examples in which the audio source 108 generates a multi-frequency test tone, the test tone generated at each frequency, decibel level, and/or time increment described herein may comprise an individual respective test tone. Accordingly, the multi-frequency test tone generated by the audio source 108 may comprise a plurality of individual and/or otherwise discrete test tones. In such examples, each of the audio sensors 106 disposed within the enclosure 102 may sense, detect, and/or otherwise determine one or more parameters of each respective test tone of the plurality of test tones. In any of the examples described herein, each audio sensor 106 may generate a respective output signal corresponding to each test tone of the plurality of test tones sensed, detected, and/or otherwise determined by the particular audio sensor 106. Such respective output signals may be indicative of, for example, at least one of the frequency, amplitude, time, duration, decibel level, bass level, treble level, presence level, and/or other acoustic parameter of the corresponding individual test tone.

Figure 8A:
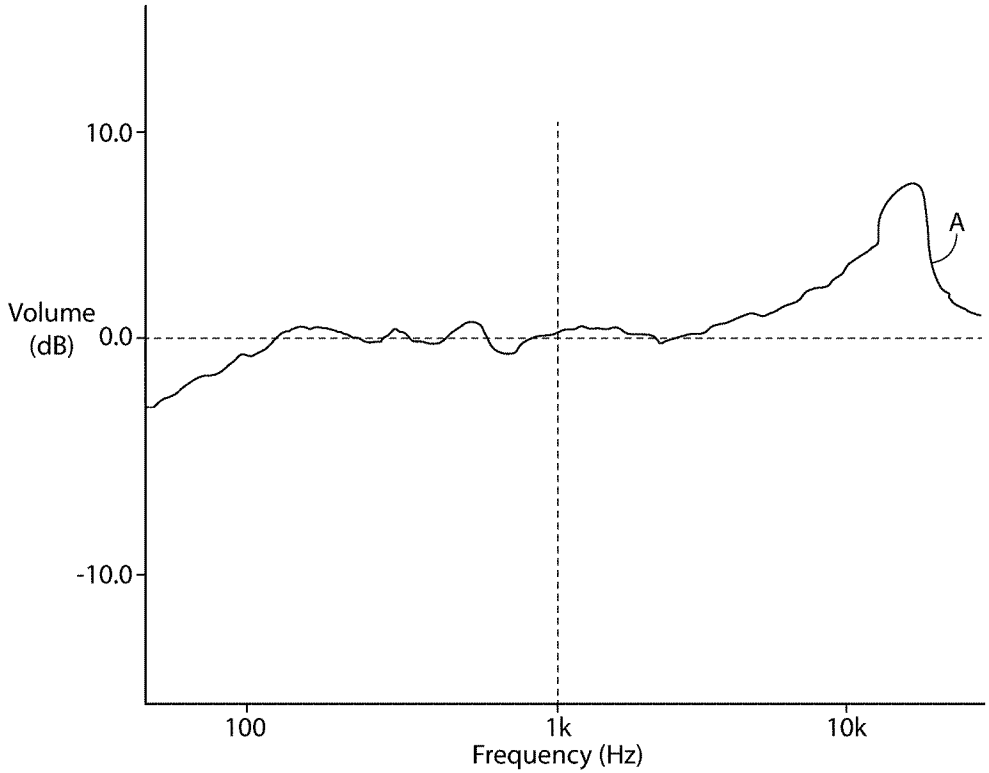
FIG. 8*a* is a plot illustrating an example frequency response corresponding to an audio sensor of the present disclosure.

At 806, the processor of the electronic device 104 may receive a signal indicative of the test tone from at least one of the audio sensors 106. For example, at 806 the processor may receive an output signal from each audio sensor 106 of the plurality of audio sensors, and each respective output signal may be indicative of a frequency response of the respective audio sensor 106. For example, each output signal may comprise a plurality of frequency values sensed by the respective audio sensor 106 for the entire time period t for which the test tone is generated by the audio source 108. Accordingly, in some examples, each output signal may comprise a plurality of frequency values, volume/decibel values, and/or amplitude values sensed by the respective audio sensor 106. Each output signal may also include a plurality of time values indicative of the particular time, within the time period t, at which each corresponding frequency, decibel, and/or amplitude value was sensed by the respective audio sensor 106. In additional examples, each output signal may also include a plurality of bass levels, treble levels, presence levels, and/or any other additional parameters determined by the respective audio sensors 106 in response to and/or otherwise associated with the test tone. For example, FIG. 8*a* illustrates a curve A representing an output signal received from an example audio sensor 106 at 806. In such an example, the output signal represented by the curve A includes a plurality of volume values (dB) sensed by the respective audio sensor 106 as a test tone was emitted within the internal space 126. In the example illustrated in FIG. 8*a*, the example test tone emitted by the audio source 108 may have increased from approximately 50 Hz to approximately 15 kHz. The curve A illustrates each volume value sensed by the audio sensor 106 across the corresponding frequency range of the test tone. Such a curve A may represent one example of a frequency response of the audio sensor 106.

At 808, the processor of the electronic device 104 may determine one or more acoustic characteristics associated with at least one of the audio sensors 106. For example, the processor may determine, based at least in part on the output signals received from each of the respective audio sensors 106, at least one acoustic characteristic of each respective audio sensor 106 of the plurality of audio sensors disposed within the internal space 126. In example embodiments, such acoustic characteristics may include, among other things, a total harmonic distortion of the respective audio sensor 106, a sensitivity of the audio sensor 106, and/or any other acoustic characteristic associated with microphones or other audio sensors. In example embodiments, the processor of the electronic device 104 may determine such acoustic characteristics at 808 in accordance with one or more algorithms, processing techniques, and/or other methods.

In such examples, the total harmonic distortion of a given audio sensor 106 may be defined as the summation of all harmonic components of a waveform (e.g., a sound wave or test tone) at a given point in a system, as compared to the fundamental component of the waveform. The total harmonic distortion of a respective audio sensor 106 may be represented as a percentage, and audio sensors 106 having a relatively low total harmonic distortion may be capable of sensing a volume, frequency, amplitude, and/or other parameter of the test tone more accurately than audio sensors 106 having a relatively high total harmonic distortion. In some examples, audio sensors 106 having a total harmonic distortion below a threshold value may be acceptable for use in some environments while audio sensors 106 having a total harmonic distortion above such a threshold value may be unacceptable for use in such environments. In some examples, such an acceptable threshold value may be approximately 10 percent. In further examples, such an acceptable threshold value may be approximately 5 percent, approximately 4 percent, approximately 3 percent, and/or any other value greater than or less than approximately 10 percent.

Additionally, in some examples the sensitivity of a given audio sensor 106 may be defined as the amount of electrical output the audio sensor produces for a given sound pressure input. The sensitivity of a respective audio sensor 106 may be represented as a decibel value, and audio sensors 106 having a relatively high sensitivity may be capable of generating a relatively higher output voltage or other signal for a given input (e.g., the test tone) than audio sensors 106 having a relatively lower sensitivity. In some examples, audio sensors 106 having a sensitivity above a threshold value may be acceptable for use in some environments while audio sensors 106 having a sensitivity below such a threshold value may be unacceptable for use in such environments. In some examples, such an acceptable threshold value may be approximately 85 dB. In further examples, such an acceptable threshold value may be approximately 90 dB, approximately 95 dB, and/or any other value greater than or less than approximately 85 dB.

For example, in some embodiments the processor and/or one or more other components of the electronic device 104 may generate a single composite audio file, data file, and/or other digital file indicative of the test tone based at least in part on each of the received output signals. Such digital files may have any format such as, for example, .wav, .mp3, .wma, .ogg, and/or other audio or data formats. In some examples, a codec and/or other hardware or software component of the system 100 may generate the audio file and provide the audio file to the processor described herein. In other examples, the processor may generate such an example audio file. For example, the processor and/or one or more other components of the electronic device 104 may record the test tone using the received output signals, and may generate a .wav file or other such audio file having separate channels or segments. In such examples, each channel or segment of the audio file may correspond to a respective output signal received from one of the audio sensors 106. Such an audio file may have a duration that corresponds to (e.g., that is substantially equal to) the time period t within which the test tone is generated by the audio source 108. At 808, the processor and/or one or more other components of the electronic device 104 may store the .wav file and/or other digital audio file in a memory associated with the electronic device 104. Additionally, at 808 the processor and/or one or more other components of the electronic device 104 may parse and/or otherwise process the audio file to determine one or more of the acoustic characteristics described herein. For example, the processor may retrieve the audio file from the memory or, alternatively, the processor may receive the audio file from one or more other components of the electronic device 104. The processor may parse and/or otherwise process the audio file by extracting information, from each of the separate channels or segments of the audio file corresponding to the respective audio sensors 106. In this way, the processor may determine a respective acoustic characteristic of each audio sensor 106 of the plurality of audio sensors using the information extracted from the audio file. In some examples, the processor may parse a .wav file at 808 to determine at least one of a sensitivity and a total harmonic distortion of each audio sensor 106, and may use such parsed and/or otherwise extracted information to determine the various acoustic characteristics of audio sensors 106 described herein. Alternatively, in other examples, such information may be provided to the processor in other digital or data formats, and without the formation of the audio files described herein. In such embodiments, the processor may determine at least one of a sensitivity and a total harmonic distortion of each audio sensor 106 without using the digital audio file described above.

Figure 8B:
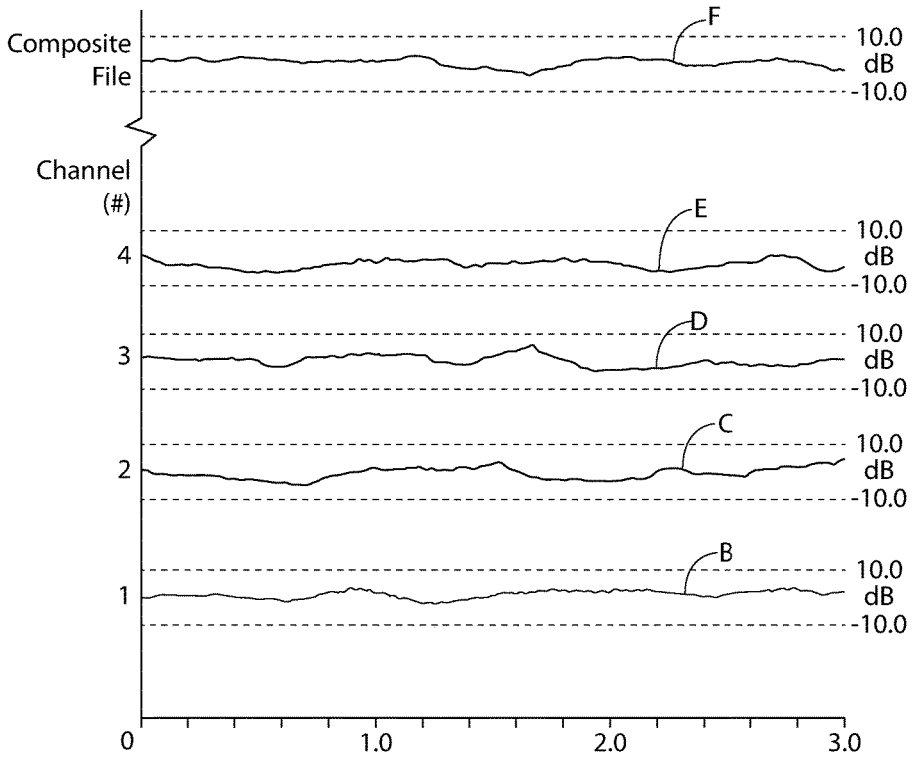
FIG. 8*b* illustrates example frequency responses corresponding to audio sensors of the present disclosure, and a visual depiction of an associated audio file.

FIG. 8*b* illustrates a visual depiction of an example audio file of the present disclosure generated by the processor at 808. As shown in FIG. 8*b*, an example .wav file and/or other digital audio file of the present disclosure may include a plurality of separate channels, and each channel (e.g., four channels are shown in FIG. 8*b*) may correspond to a single respective audio sensor 106 used to sense one or more parameters of the test tone at 804. Each separate channel of the audio file may store and/or otherwise include an output signal and/or other output data from a respective audio sensor. The output signal and/or other output data stored in each respective channel may comprise output data for each test tone of a plurality of test tones emitted by the audio source 108. For example, FIG. 8*b* illustrates curves B, C, D, E, and each of the curves B, C, D, E represents a respective output signal and/or other output data received from a respective audio sensor 106 at 806. In such an example, the output signals and/or other output data represented by the curves B, C, D, E include a plurality of volume values (dB) sensed by the respective audio sensor 106 as one or more test tones were emitted within the internal space 126 for approximately 3.0 ms. Such example curves B, C, D, E may represent example frequency responses of the audio sensors 106. In particular, the curve B may represent output data received from a first audio sensor 106(1) as the audio sensor 106(1) sensed a plurality of test tones for approximately 3.0 ms, the curve C may represent output data received from a second audio sensor 106(2) as the audio sensor 106(2) sensed the same plurality of test tones for approximately 3.0 ms, the curve D may represent output data received from a third audio sensor 106(3) as the audio sensor 106(3) sensed the plurality of test tones for approximately 3.0 ms, and the curve E may represent output data received from a first audio sensor 106(4) as the audio sensor 106(4) sensed the plurality of test tones for approximately 3.0 ms. As shown in FIG. 8*b*, an example composite audio file of the present disclosure, generated by the processor at 808, may also include a separate curve F representing a digital summation and/or other combination of the output signals included in the separate channels of the audio file. For example, the curve F may represent a combination of the output signals stored in example channels 1-4 (illustrated by curves B, C, D, E, respectively).

At 810, the processor of the electronic device 104 may compare the acoustic characteristic, determined at 808, to a corresponding acoustic characteristic reference value. For example, one or more such reference values may be determined empirically through repeated testing and/or analysis of audio sensors 106 over time, and such values may be stored in the memory associated with the electronic device 104. Alternatively, such reference values may be selected by a manufacturer and/or designer of an audio sensor and used to evaluate the performance of audio sensors under various conditions. Upon determining the acoustic characteristic of a particular audio sensor 106 at 808, the processor may compare the determined acoustic characteristic to the stored reference value, and may evaluate whether or not the determined acoustic characteristic, and thus the corresponding audio sensor, is acceptable based on the stored reference value.

For example, at 808 the processor may determine, based at least in part on an output signal received at 806, that a particular audio sensor 106 has a total harmonic distortion of 3.7 percent. At 810 the processor may determine a difference between the total harmonic distortion of the audio sensor 106 determined at 808 and a corresponding total harmonic distortion reference value stored in the memory. In such an example, if the total harmonic distortion reference value stored in the memory is 3.5 percent, the processor may determine a difference equal to −0.2 percent using the following equation:

$$\text{difference}=\text{reference value}-\text{acoustic characteristic}.$$

In some examples, such a difference may be, for example, an absolute value representing the net difference between the reference value and the value of the acoustic characteristic determined at 808. Alternatively, in other examples, the differences determined at 810 may have positive or negative values. Further, at 810 each of the acoustic characteristics determined at 808 may be compared to the reference value. Thus, at 810 differences may be determined between the stored reference value and the respective acoustic characteristics determined for each audio sensor at 808.

At 812, the processor may determine whether one or more of the differences calculated at 810 is within a predetermined range of the corresponding reference value. In some examples, such a range may have a positive value representing an upper threshold of the range and a negative value representing a lower threshold of the range. Such ranges can have any positive and negative threshold values, and such positive and negative threshold values may be different for each corresponding acoustic characteristic. For example, a predetermined range corresponding to a total harmonic distortion reference value may have positive and negative threshold values of approximately +/−0.1 percent, +/−0.2 percent, +/−0.5 percent, +/−1.0 percent, +/−2.0 percent, and/or any other values. In other examples, a predetermined range corresponding to a sensitivity reference value may have positive and negative threshold values of approximately +/−0.1 dB, +/−0.2 dB, +/−0.5 dB, +/−1.0 dB, +/−2.0 dB, and/or any other values. In some examples, at 812 the processor may determine whether each of the differences calculated at 810 is within a predetermined range of the corresponding reference value. As shown in FIG. 8, if the processor determines at 812 that a difference for a respective audio sensor is outside of the corresponding predetermined range (812—No), the processor may generate an alarm, provide a message to a user of the system 100, and/or perform any other operation associated with indicating that the particular audio sensor 106 under consideration has a difference outside of the corresponding predetermined range. Such an operation may indicate that the particular audio sensor is damaged, faulty, and/or otherwise undesirable or unacceptable for use. Control may then proceed to 802. If, on the other hand, the processor determines at 812 that a difference for a respective audio sensor is within the corresponding predetermined range (812—Yes), control may proceed to 814.

At 814, the processor may determine a compensation factor of one or more audio sensors 106 based at least in part on the respective output signal of the particular audio sensor 106. In particular, at 814 the processor may determine such respective compensation factors for the one or more audio sensors having differences determined to be within the corresponding predetermined ranges (see 812). Such a compensation factor may be, for example, an offset value, a multiplier, a ratio, a percentage, and/or any other value that may be used to affect the functionality of a device with which a corresponding audio sensor 106 is used. As part of determining a compensation factor associated with one or more of the audio sensors 106, the processor may generate an average frequency response for each audio sensor 106 of the plurality of audio sensors 106. For example, the processor may average the frequency sensed by each respective audio sensor 106 within a frequency range of the test tone (e.g., within a frequency range between approximately 200 Hz and approximately 800 Hz). In further example embodiments a different frequency range of the test tone may be chosen. In further examples, the average frequency response may be determined based on the frequencies sensed by a subset of the plurality of audio sensors 106, such as based on the frequencies sensed by the one or more audio sensors 106 having differences determined to be within the corresponding predetermined ranges (see 812). As part of determining the compensation factor at 814, the processor may also generate an average value. Such an average value may comprise an average of each of the average frequency responses associated with the plurality of audio sensors 106.

For example, in an embodiment in which seven audio sensors are used, the processor may determine the following average frequency responses ("$afr_n$") for the respective audio sensors: $afr_1$=602 Hz, $afr_2$=608 Hz, $afr_3$=609 Hz, $afr_4$=598 Hz, $afr_5$=613 Hz, $afr_6$=595 Hz, and $afr_7$=605 Hz. In such an example embodiment, at 814 the processor may also determine an average value ("avg") equal to approximately 604.3 Hz, based on the above average frequency responses. In further examples, such an average value avg may be calculated using only the frequency responses corresponding to audio sensors for which the corresponding difference determined at 810 is within the predetermined range (step 812—yes).

At 814, the processor may generate a compensation factor corresponding to a particular audio sensor 106 based at least in part on the average value (avg). For example, the processor may generate a ratio of each frequency response to the average value avg based on the following equation or relationship:

$$ratio=fr/avg,$$

where "fr" represents the frequency response of a respective audio sensor 106. Additionally, at 814 the processor may generate a compensation factor based on the following equation or relationship:

$$compensation\ factor=sqrt(1/ratio).$$

Accordingly, in the example embodiment described above, at 814 the processor may generate a ratio associated with a first audio sensor 106(1) equal to 602 Hz/604.3 Hz. Based on such a ratio, the processor may generate a compensation factor corresponding to the first audio sensor 106(1) equal to approximately 1.002.

As noted above, at 814, the processor may generate a respective compensation factor for each audio sensor 106 of the plurality of audio sensors. Additionally, at 814, the processor may convert the generated compensation factors to fixed point numbers, may compare the compensation factors to one or more acceptable ranges, and/or may otherwise process the compensation factors for future use. It is also understood that in still further embodiments, any of the acoustic characteristic determinations, compensation factor determinations, average determinations, ratio determinations, and/or other determinations described herein may be performed empirically. Such empirical determinations may be performed without using one or more of the equations described herein and, instead, may be accomplished through repeated testing and analysis of different audio sensors 106 and/or audio sources 108.

At 816, the processor may store compensation factors, determined at 814, in the memory associated with the electronic device 104. In some examples, the processor may store each compensation factor, together with an indicator indicative of the particular audio sensor to which the respective compensation factor corresponds, in the memory. Storing the compensation factors in this way may make it easier for such compensation factors to be applied/or otherwise utilized to affect data collected and/or generated by the respective audio sensors 106.

For example, at 818 one or more of the compensation factors determined at 814 may be associated with, linked to, and/or otherwise applied to the various signals received from and/or data generated by a respective audio sensor 106 of the present disclosure. In some example embodiments, associating, linking, and/or otherwise applying the compensation factor to a signal or data generated by an audio sensor 108 may result in a modified signal and/or modified data. For example, at 818 the processor may control at least one of the audio sensors 106 to detect and/or otherwise sense a voice input and/or other sound wave external to the enclosure 102. In such examples, the at least one audio sensor 106 may generate an output signal indicative of and/or otherwise corresponding to the sensed voice input, and the processor may receive the output signal from the at least one audio sensor 106. Such an output signal may be indicative of a frequency response of the at least one audio sensor 106 corresponding to the voice input. As noted above with respect to step 806, such an output signal may include, for example, a plurality of frequency values, volume/decibel values, and/or amplitude values sensed by the respective audio sensor 106. Each such an output signal may also include a plurality of time values indicative of the particular time, within the time period t, at which each corresponding frequency, decibel, and/or amplitude value was sensed by the respective audio sensor 106. In additional examples, such an output signal may also include a plurality of bass levels, treble levels, presence levels, and/or any other additional parameters determined by the respective audio sensors 106 in response to and/or otherwise associated with the test tone. In such examples, at 818 the processor may generate a modified output signal and/or modified data using the compensation factor. For example, at 818 the processor may generate modified frequency response data by adding the compensation factor to each value of the plurality of frequency values included in the received output signal, by multiplying each value of the plurality of frequency values included in the received output signal by the compensation factor, by dividing each value of the plurality of frequency values included in the received output signal by the compensation factor, and/or by performing any other mathematical, algorithmic, and/or analog/digital processing function using the compensation factor and the plurality of values included in the received output signal as inputs.

In further examples, at least one of the audio sensors 106 may be incorporated into a computing device, or other such device. In such examples, the compensation factor corresponding to the at least one audio sensor 106 may also be stored in a memory of the computing device such that voice input and/or other audio signals sensed by the at least one audio sensor 106 may be conditioned and/or otherwise modified, such as by a processor of the computing device, based on the compensation factor corresponding to the at least one audio sensor 106.

Figure 9:
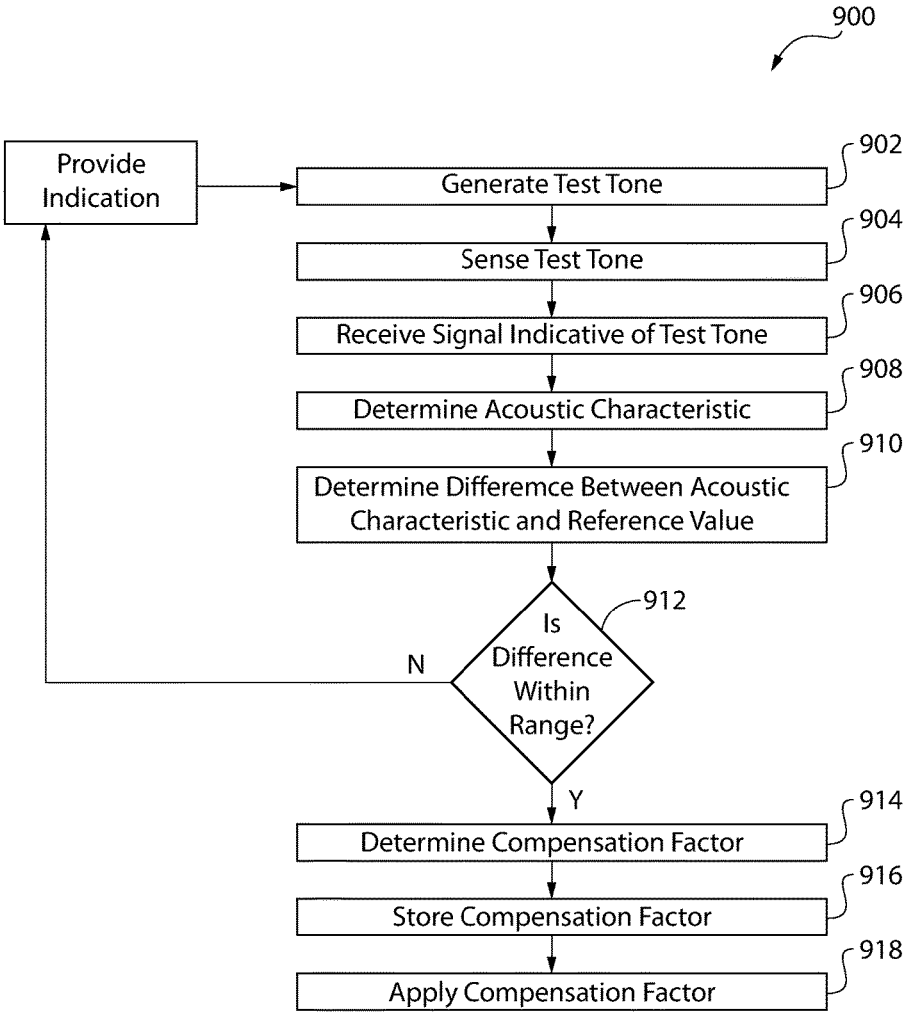
FIG. 9 is a flow diagram illustrating another example method of the present disclosure.

FIG. 9 illustrates a flow diagram of another example method 900 of the present disclosure. In some instances, the method 900, or portions thereof, may be substantially similar to and/or identical to corresponding portions of the method 800 described above with respect to FIG. 8. Accordingly, various portions of the method 900 will be described briefly below for clarity. It is understood, however, that any of the descriptions of the method 800 described herein may be equally applicable to the example method 900 shown in FIG. 9. Additionally, one or more of the processes described above with respect to the example method 800 may be included in the example method 900 and vice versa. For ease of description, the method 900 will be described with reference to the example system 100 of FIG. 1, and the example audio sources 702, 704 and audio sensor 106 configuration illustrated in FIG. 7 unless otherwise specified.

At 902, the method 900 includes controlling, with a processor of at least one of the electronic devices 104, the audio sources 702, 704 to generate a test tone. As noted above, in some examples, the test tone may comprise a multi-frequency test tone generated by the audio sources 702, 704, in concert, for a predetermined length of time, and/or at a predetermined decibel level. In particular, the processor may drive the audio sources 702, 704 substantially simultaneously to generate respective sound waves, and each respective sound wave may be characterized by a particular range of frequencies. Together, the sound waves emitted by the audio sources 702, 704 may comprise the test tone. In some examples, the test tone frequency may be between approximately 80 Hz to approximately 10 kHz. In particular, the respective sound waves generated by the audio sources 702, 704 may combine to form a single test tone characterized by a frequency between approximately 80 Hz and approximately 10 kHz. In some examples, the frequency, decibel level, and/or other parameters of the test tone may remain constant during at least part of the method 900 illustrated in FIG. 9. Alternatively, in additional examples, one or more parameters of the test tone may change during at least part of the method 900. For example, in some embodiments, the processor of the electronic device 104 may control the audio sources 702, 704 to increase, and/or decrease the frequency of the test tone incrementally or at any desired rate. For example, the processor may control the audio sources 702, 704 to increase the frequency of the test tone in increments of approximately 1 Hz, 2 Hz, 5 Hz, 10 Hz, 20 Hz, and/or any other frequency increment. Additionally, the processor may control the audio sources 702, 704 to increase the frequency of the test tone in increments of approximately 1 ms, 2 ms, 5 ms, 10 ms, 20 ms, 100 ms, and/or any other time increment. Alternatively, in additional embodiments, other frequency ranges, and/or time increments may be utilized by the processor in order to produce variations in the test tone.

At 904, the processor of the electronic device 104 may control the audio sensor 106 disposed within the enclosure 102 to sense, and/or otherwise determine the test tone generated by the audio sources 702, 704. For example, the processor may control the audio sensor 106 to determine the presence of the test tone within the internal space. Additionally or alternatively, the processor may control the audio sensor 106 to determine one or more parameters of the test tone. Such parameters may include, for example, one or more of a frequency, amplitude, time, duration, decibel level, bass level, treble level, presence level, and/or other acoustic parameter.

At 906, the processor of the electronic device 104 may receive a signal indicative of the test tone from the audio sensor 106. For example, at 906 the processor may receive an output signal from the audio sensor 106, and the output signal may be indicative of a frequency response of the audio sensor 106. For example, the signal may comprise a plurality of frequency values sensed by the audio sensor 106 for the entire time period t for which the test tone is generated by the audio sources 702, 704. Accordingly, in some examples, the output signal may comprise a plurality of frequency values, volume values, and/or amplitude values sensed by the audio sensor 106. The output signal may also comprise a plurality of time values indicative of the particular time, within the time period t, at which each corresponding frequency values, volume values, and/or amplitude values were sensed. In additional examples, each output signal may also include a plurality of bass levels, treble levels, presence levels, and/or any other additional parameters determined by the audio sensor 106 in response to and/or otherwise associated with the test tone. As noted above, FIG. 8*a* illustrates a curve A representing an example output signal received from an audio sensor 106. Such a curve A may be, for example, illustrative of an output signal and/or other frequency response received at 906.

At 908, the processor of the electronic device 104 may determine one or more acoustic characteristics associated with the audio sources 702, 704. For example, the processor may determine, based at least in part on the output signal received from the audio sensor 106, at least one acoustic characteristic of each respective audio source 702, 704. In example embodiments, such acoustic characteristics may include, among other things, a total harmonic distortion, a sensitivity, a frequency response, a rub & buzz, and/or any other acoustic characteristic associated with woofers, tweeters, speakers, and/or other audio sources. In example embodiments, the processor of the electronic device 104 may determine such acoustic characteristics at 908 in accordance with one or more algorithms, processing techniques, and/or other methods.

For example, in some embodiments the processor and/or one or more other components of the electronic device 104 may generate a single composite audio file, data file, and/or other digital file indicative of the test tone based at least in part on each of the received output signals. Such digital files may have any format such as, for example, .wav, .mp3, .wma, .ogg, and/or other audio or data formats. In such examples, the processor and/or one or more other components of the electronic device 104 may record the test tone using the audio sensor 106, and may generate a single .wav file and/or other such audio file having separate channels or segments corresponding to the respective audio sources 702, 704. As noted above, FIG. 8*b* illustrates an example composite audio file of the present disclosure generated by the processor at 808. As shown in FIG. 8*b*, an example .wav file and/or other digital audio file of the present disclosure may include a plurality of separate channels, and each channel may correspond to a single respective audio sensor 106 used to sense the test tone. Although the example audio file illustrated by FIG. 8*b* includes four separate channels, an example audio file generated by the processor at 908 may include a single channel corresponding to the audio sensor 106 shown in FIG. 7. In further embodiments, an example audio file generated by the processor at 908 may include more than one channel.

At 908, the processor and/or one or more other components of the electronic device 104 may store the audio file in a memory associated with the electronic device 104. Additionally, at 908 the processor and/or one or more other components of the electronic device 104 may parse and/or otherwise process the .wav file and/or other digital audio file to determine one or more of the acoustic characteristics described above with respect to the audio sources 702, 704. For example, the processor may retrieve the audio file from the memory or, alternatively, the processor may receive the audio file from one or more other components of the electronic device 104. The processor may parse and/or otherwise process the audio file by extracting information, from each of the separate channels or segments of the audio file corresponding to the respective audio sources 702, 704. In this way, the processor may determine a respective acoustic characteristic of each audio source 702, 704. Such operations may be similar to those described above with respect to block 808 of method 800.

At 910, the processor of the electronic device 104 may compare the acoustic characteristic, determined at 908, to a corresponding acoustic characteristic reference value. For example, one or more such reference values may be determined empirically through repeated testing and/or analysis of audio sources 702, 704 over time, and such values may be stored in the memory associated with the electronic device 104. Alternatively, such reference values may be selected by a manufacturer and/or designer of an audio source, and used to evaluate the performance of the audio sources 702, 704 under various conditions. The processor may compare a determined acoustic characteristic to a stored reference value, and may evaluate whether or not the determined acoustic characteristic, and thus the corresponding audio source, is acceptable based on the stored reference value.

For example, at 910 the processor may determine, for each audio source 702, 704, a difference between the acoustic characteristic determined at 908 and a corresponding acoustic characteristic reference value stored in the memory. For example, in embodiments in which the acoustic characteristic comprises a total harmonic distortion of the audio source 702, the processor may determine at 908, based at least in part on an output signal received at 906, that the audio source 702 has a total harmonic distortion or 2.6 percent. At 910, the processor may determine a difference between the total harmonic distortion of the audio source 702 and a corresponding total harmonic distortion reference value stored in the memory. In such an example, if the total harmonic distortion reference value stored in the memory is 3.0 percent, the processor may determine a difference equal to 0.4 percent using the equation noted above with respect to block 810 of method 800.

At 912, the processor may determine whether one or more of the differences calculated at 910 is within a predetermined range of the corresponding reference value. As noted above with respect to block 812 of the method 800, in some examples such a range may have a positive value representing an upper threshold of the range and a negative value representing a lower threshold of the range. Such ranges can have any positive and negative threshold values, and such positive and negative threshold values may be different for each corresponding acoustic characteristic. For example, a predetermined range corresponding to a total harmonic distortion reference value may have positive and negative threshold values of approximately +/−0.1 percent, +/−0.2 percent, +/−0.5 percent, +/−1.0 percent, +/−2.0 percent, and/or any other values. For example, at 912 the processor may determine whether the calculated differences, for each of the audio sources 702, 704, is within a predetermined range of the corresponding reference value. If the processor determines at 912 that a difference for a respective audio source 702, 704 is outside of the corresponding predetermined range (912—No), the processor may generate an alarm, provide a message to a user of the system 100, and/or perform any other operation associated with indicating that the particular audio source 702, 704 under consideration has a difference outside of the corresponding predetermined range. Such an operation may indicate that the particular audio source is damaged, faulty, and/or otherwise undesirable or unacceptable for use. Control may then proceed to 902. If, on the other hand, the processor determines at 912 that a difference for a respective audio source is within the corresponding predetermined range (912—Yes), control may proceed to 914.

At 914, the processor may determine a compensation factor of one or both of the audio sources 702, 704 based at least in part on the output signal of the audio sensor 106 received at 906. In particular, at 914 the processor may determine such respective compensation factors for the one or more audio sources having differences determined to be within the corresponding predetermined ranges (see 912). Such a compensation factor may be, for example, an offset value, a multiplier, a ratio, a percentage, and/or any other value that may be used to affect the functionality of a device with which a corresponding audio source 702, 704 is used. As part of determining a compensation factor associated with one or both of the audio sources 702, 704 the processor may generate an average frequency response for each of the audio sources 702, 704. At 914, the processor may also generate an average value. Such an average value may comprise an average of the average frequency responses associated with the audio sources 702, 704. At 914, the processor may also generate the compensation factor corresponding to one or both of the audio sources 702, 704 based at least in part on the average value. The operations performed by the processor at 914 may be similar to those described above with block 814 of the method 800. It is also understood that in still further embodiments, any of the acoustic characteristic determinations, compensation factor determinations, average determinations, ratio determinations, and/or other determinations associated with the method 900 may be performed empirically. Such empirical determinations may be performed without using one or more of the equations described herein and, instead, may be accomplished through repeated testing and analysis of different audio sensors 106 and/or audio sources 702, 704.

At 916, the processor may store compensation factors determined at 914, in the memory associated with the electronic device 104. In some examples, the processor may store each compensation factor, together with an indicator indicative of the particular audio source 702, 704 to which the respective compensation factor corresponds, in the memory. Storing the compensation factors in this way may make it easier for such compensation factors to be applied/or otherwise utilized to affect the sound wave and/or other output generated by the respective audio source 702, 704.

For example, at 918 one or more of the compensation factors determined at 914 may be associated with, linked to, and/or otherwise applied to a sound wave and/or other output signal generated by a respective audio source 702, 704 of the present disclosure. At 918, the processor may control, for example, at least one of the audio sensors 106 to detect and/or otherwise sense a voice input and/or other sound wave external to the enclosure 102. In such examples, the at least one audio sensor 106 may generate an output signal, and the processor may receive the output signal from the at least one audio sensor 106. The processor may also control the audio sources 702, 704 to generate a sound wave and/or other output signal in response to the input received by the audio sensor 106. In such examples, the processor may modify the control of the audio sources 702, 704 when generating the sound wave using and/or otherwise based on the compensation factor. For example, in embodiments in which the calculated compensation factor requires an increase or decrease in gain, decibel level, bass, treble, and/or other acoustic characteristics of the sound wave, the processor may affect a corresponding increase or decrease in the appropriate acoustic characteristics based on the respective compensation factor. For example, similar to the processes discussed above with respect to step 818, the processor may generate an initial audio source control command including values indicating a desired decibel level, frequency, gain, bass, treble, and/or other sound wave acoustic characteristic. The processor may then modify one or more of these values by adding the compensation factor to each value, by multiplying each value by the compensation factor, by dividing each value by the compensation factor, and/or by performing any other mathematical, algorithmic, and/or analog/digital processing function using the compensation factor and the plurality of values included in the initial audio source control command as inputs. In this way, the processor may generate a modified audio source control command using the compensation factor, and may control the audio sources 702, 704 to generate one or more sound waves and/or other outputs using and/or based on the modified audio source control command. Accordingly, control of the audio sources 702, 704 may be modified by the processor using and/or otherwise based on the compensation factor corresponding to the particular audio sources 702, 704.

Figure 10:
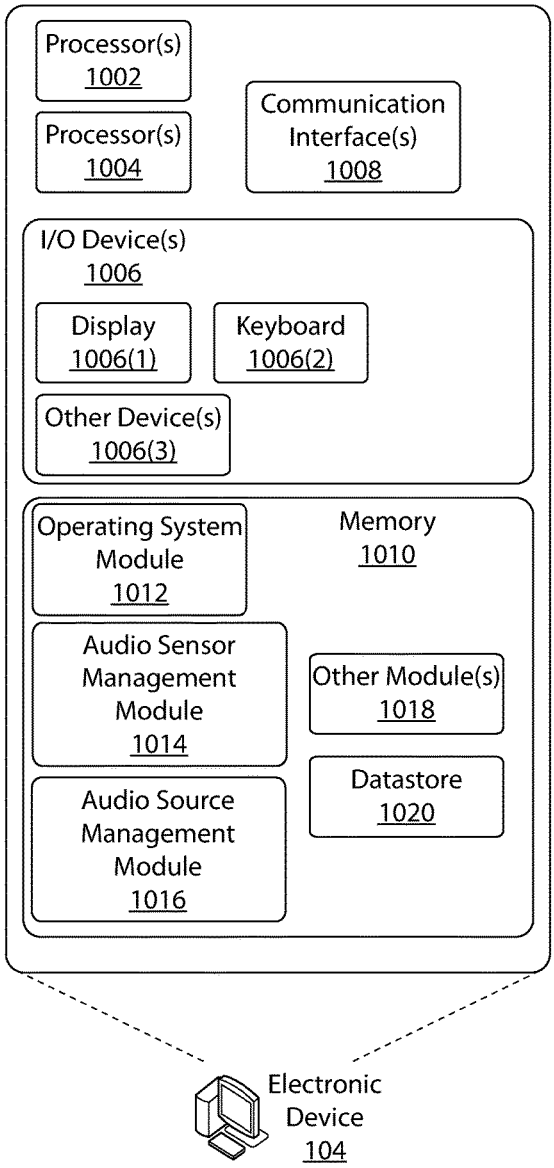
FIG. 10 is a schematic diagram illustrating an example electronic device of the present disclosure.

FIG. 10 is a block diagram of the electronic device 104. The electronic device 104 may include one or more processors 1002 configured to execute stored instructions. The processors 1002 may comprise one or more cores. The electronic device 104 may include one or more input/output ("I/O") interface(s) 1004 to allow the electronic device 104 to communicate with other devices. The I/O interfaces 1004 may comprise inter-integrated circuit ("12C"), serial peripheral interface bus ("SPI"), universal serial bus ("USB"), RS-232, media device interface, and so forth.

The I/O interface(s) 1004 may couple to one or more I/O devices 1006. The I/O device(s) 1006 may include one or more displays 1006(1), keyboards 1006(2), mice, touchpads, touchscreens, and/or other such devices 1006(3). The one or more displays 1006(1) may be configured to provide visual output to the user. For example, the displays 1006(1) may be connected to the processor(s) 1002 and may be configured to render and/or otherwise display content thereon. For example, the compensation factors, acoustic characteristics, and/or other information described above may be displayed on the display 1006(1). Such information may include one or more charts, plots, graphs, lists, diagrams, and/or other visual indicia of information.

As noted above, each of the various audio sensors 106 and audio sources 108 described herein may be coupled to the electronic device 104 and, in particular, such audio sensors 106 and audio sources 108 may be coupled to the one or more processor(s) 1002. The processor(s) 1002 may be configured to control and receive input from the audio sensors 106 to perform any of the operations described herein with respect to methods 800 and 900.

The electronic device 104 may also include one or more communication interfaces 1008 configured to provide communications between the electronic device 104 and other devices, as well as between the electronic device 104 and various components of the system 100. Such communication interface(s) 1008 may be used to connect to one or more personal area networks ("PAN"), local area networks ("LAN"), wide area networks ("WAN"), and so forth. For example, the communications interfaces 1008 may include radio modules for a WiFi LAN and a Bluetooth PAN. The electronic device 104 may also include one or more busses or other internal communications hardware or software that allow for the transfer of data between the various modules and components of the electronic device 104.

As shown in FIG. 10, the electronic device 104 includes one or more memories 1010. The memory 1010 comprises one or more non-transitory computer-readable storage media ("CRSM"). The CRSM may be anyone or more of an electronic storage medium, a magnetic storage medium, an optical storage medium, a quantum storage medium, a mechanical computer storage medium and so forth. The memory 1010 provides storage of computer readable instructions, data structures, program modules and other data for the operation of the electronic device 104. The memory 1010 may be connected to the processor(s) 1002, and may store inputs received from the audio sensors 106.

The memory 1010 may include at least one operating system (OS) module 1012. The OS module 1012 is configured to manage hardware resources such as the I/O interfaces 1004 and provide various services to applications or modules executing on the processors 1002. Also stored in the memory 1010 may be an audio sensor management module 1014, an audio source management module 1016, and other modules 1018. The audio sensor management module 1014 is configured to provide for control and adjustment of the various microphones and/or other audio sensors 106 described herein. Likewise, the audio source management module 1016 is configured to provide for control and adjustment of the various speakers and/or other audio sources described herein. The audio source management module 1016 and the audio sensor management module 1014 may be configured to respond to one or more signals from the processor(s) 1002 and/or to provide one or more signals to the processor(s) 1002 to assist in controlling operation of the audio source(s) 108 and the audio sensor(s) 106, respectively. Other modules 1018 may also be stored in the memory 1010. For example, a rendering and/or display module may be configured to process inputs and/or for presentation of output information on the display. Additionally, a computation module may be configured to assist the processor(s) 1002 in generating one or more digital audio files (e.g., .wav files), parsing one or more such audio files, and/or determining the acoustic characteristics, compensation factors, ratios, differences, and other parameters described herein.

The memory 1010 may also include a datastore 1020 to store information. The datastore 1020 may use a flat file, database, linked list, tree, or other data structure to store the information. In some implementations, the datastore 1020 or a portion of the datastore 1020 may be distributed across one or more other devices including servers, network attached storage devices and so forth. The data store 1020 may store the various reference values, compensation factors, identifiers, differences, and/or other information described herein. Other data may also be stored in the datastore 1020 such as the results of various tests performed using the system 100 and so forth.

While FIG. 10 illustrates various example components, the electronic device 104 may also include additional components, features, or functionality. For example, the electronic device 104 may also include additional data storage devices (removable and/or non-removable) such as, for example, magnetic disks, optical disks, or tape. The additional data storage media may include volatile and nonvolatile, removable and non-removable media implemented in any method or technology for storage of information, such as computer readable instructions, data structures, program modules, or other data. In addition, some or all of the functionality described in association with the electronic device 104 may reside remotely from the electronic device 104 in some implementations. In these implementations, the electronic device 104 may utilize the communication interface(s) 1008 to communicate with and utilize this functionality.

As noted above, example embodiments of the present disclosure enable the testing and/or calibration of a plurality of audio sensors 106 and of a plurality of audio sources 108. For example, the system 100 described herein may include at least one audio source 108 configured to emit a test tone within the enclosure 102, and may include a plurality of audio sensors 106 disposed in an array and/or other configuration within the enclosure 102 to sense the test tone substantially simultaneously. One or more electronic devices 104 may receive signals from the audio sensors 106 indicative of the respective frequency responses of the audio sensors 106 to the test tone, and may determine a compensation factor associated with each audio sensor 106 based on the frequency response. This compensation factor may be employed to condition, modify, and/or otherwise affect further inputs received from such audio sensors 106.

In still other embodiments, the system 100 may include two or more audio sources 702, 704 within the enclosure 102, and may include at least one audio sensor 106 disposed within the enclosure 102 to sense a test tone generated by the two or more audio sources 702, 704. One or more electronic devices 104 may receive signals from the audio sensor 106 indicative of the test tone, and may determine one or more acoustic characteristics of the respective audio sources 702, 704 based on the received signals. In some examples, the one or more electronic devices 104 may determine a respective compensation factor associated with each of the audio sources 702, 704. In such examples, the respective compensation factors may be employed to condition, modify, and/or otherwise affect sound waves and/or other outputs generated by the audio sources 702, 704.

As a result of the embodiments described herein, a plurality of audio sensors may be tested and/or otherwise evaluated at the same time using a single test tone. Since each of the audio sensors sense the same test tone simultaneously, the accuracy of the evaluation and calibration of the respective sensors is improved. Known systems may not be configured to test and/or otherwise evaluate a plurality of audio sensors simultaneously, and as a result, the accuracy of such known systems may suffer in some testing environments.

Additionally, in the various embodiments of the present disclosure two or more audio sources may be activated to simultaneously emit respective sound waves, and together, these sound waves may combine to form a single test tone. In such embodiments, an audio sensor may sense the test tone, and various acoustic characteristics of the two or more audio sources may be determined based on an output of the audio sensor. Since each of the audio sources emit respective sound waves simultaneously, the time required to test such audio sources is reduced. Known systems may not be configured to test and/or otherwise evaluate a plurality of audio sources simultaneously, and as a result, the efficiency of such known systems may suffer in some testing environments.

Accordingly, the example systems and methods of the present disclosure offer unique and heretofore unworkable approaches to audio source and audio sensor testing and/or calibration. Such methods reduce the time required for such testing and/or calibration, improve the accuracy of such operations, and improve the quality of the devices into which the audio sources and/or audio sensors are incorporated.

CONCLUSION

Although the techniques have been described in language specific to structural features and/or methodological acts, it is to be understood that the appended claims are not necessarily limited to the features or acts described. Rather, the features and acts are described as example implementations of such techniques.

Alternate implementations are included within the scope of the examples described herein in which elements or functions may be deleted, or executed out of order from that shown or discussed, including substantially synchronously or in reverse order, depending on the functionality involved as would be understood by those skilled in the art. It should be emphasized that many variations and modifications may be made to the above-described examples, the elements of which are to be understood as being among other acceptable examples. All such modifications and variations are intended to be included herein within the scope of this disclosure and protected by the following claims.

The invention claimed is:

1. An apparatus for testing a plurality of microphones, comprising:

a soundproof enclosure;

a speaker located within the enclosure;

a first microphone, a second microphone, and a third microphone all located in a common plane within the enclosure and spaced apart from each other and the speaker; and a processor coupled to the speaker and the first, the second, and the third microphones, wherein the processor in conjunction with the speaker and the first, the second, and the third microphones is configured to:

generate a plurality of test tones, each test tone of the plurality of test tones having an associated frequency, for each test tone of the plurality of test tones:

receive first output data from the first microphone, second output data from the second microphone, and third output data from the third microphone, each of the first, the second, and the third output data including information about a frequency response of the respective microphone corresponding to the test tone, generate an audio file, the audio file comprising a first channel including output data of the first microphone for the plurality of test tones, a second channel including output data of the second microphone for the plurality of test tones, and a third channel including output data of the third microphone for the plurality of test tones, determine, using the audio file, a first acoustic characteristic of the first microphone, a second acoustic characteristic of the second microphone, and a third acoustic characteristic of the third microphone, determine a first difference between the first acoustic characteristic and a reference value, a second difference between the second acoustic characteristic and the reference value, and a third difference between the third acoustic characteristic and the reference value, determine that the first difference is within a predetermined range of the reference value, and generate, based at least in part on the output data of the first microphone for the plurality of test tones, a compensation factor of the first microphone.

2. The apparatus of claim 1, wherein the acoustic characteristic of the first microphone comprises at least one of a sensitivity and a total harmonic distortion of the first microphone.

3. The apparatus of claim 1, wherein the plurality of test tones are in a frequency range from approximately 80 Hz to approximately 10 kHz and wherein a time between two successive test tones of the plurality of test tones is approximately 20 ms.

4. The apparatus of claim 1, wherein the processor is further configured to:

receive additional output data from the first microphone, the additional output data including information about a frequency response of the first microphone corresponding to a voice input sensed by the first microphone and originating external to the enclosure after the plurality of test tones have been generated; and generate modified frequency response data based at least in part on the additional output data and using the compensation factor of the first microphone.

5. The apparatus of claim 1, wherein the first microphone is spaced from the second microphone and the third microphone by a first radial distance, and wherein a plurality of additional microphones disposed within the common plane are spaced radially from the first microphone by the first distance, each microphone of the plurality of additional microphones being spaced from an adjacent microphone by a second distance.

6. The apparatus of claim 1, wherein the first, second, and third microphones are disposed along a common axis within the common plane, and the first microphone is disposed between the second and third microphones.

7. A method, comprising:

generating a first test tone, at a first frequency, with an audio source disposed within a substantially soundproof enclosure;

receiving first output data from a first audio sensor disposed within the enclosure, the first output data including information about a parameter of the first test tone as determined by the first audio sensor;

receiving second output data from a second audio sensor disposed within the enclosure and spaced from the first audio sensor, the second output data including information about the parameter of the first test tone as determined by the second audio sensor;

determining an acoustic characteristic of the first audio sensor based at least in part on the first output data;

determining an acoustic characteristic of the second audio sensor based at least in part on the second output data;

determining a first difference between the acoustic characteristic of the first audio sensor and a reference value;

determining a second difference between the acoustic characteristic of the second audio sensor and the reference value;

determining that the first difference is within a predetermined range of the reference value; and generating a compensation factor of the first audio sensor based at least in part on determining that the first difference is within the predetermined range and using the first output data.

8. The method of claim 7, wherein the acoustic characteristic of the first audio sensor comprises at least one of a sensitivity and a total harmonic distortion.

9. The method of claim 7, further comprising generating a second test tone at a second frequency higher than the first frequency;

receiving third output data from the first audio sensor, the third output data including information about a parameter of the second test tone as determined by the first audio sensor;

receiving fourth output data from the second audio sensor, the fourth output data including information about the parameter of the second test tone as determined by the second audio sensor;

determining the acoustic characteristic of the first audio sensor based at least in part on the first and third output data; and determining the acoustic characteristic of the second audio sensor based at least in part on the second and fourth output data.

10. The method of claim 9, further comprising:

generating an average frequency response of the first audio sensor based at least in part on the first and third output data;

generating an average frequency response of the second audio sensor based at least in part on the second and fourth output data;

generating an average value using the average frequency response of the first audio sensor and the average frequency response of the second audio sensor; and generating the compensation factor of the first audio sensor based at least in part on the average value.

11. The method of claim 7, wherein the first and second audio sensors are disposed in a common first plane, and the audio source is disposed in a second plane spaced from the first plane by a first distance.

12. The method of claim 7, further comprising:

determining that the second difference is outside of the predetermined range of the reference value; and providing an indication, via a display associated with the processor, that the second difference is outside of the predetermined range and identifying the second audio sensor.

13. The method of claim 7, further comprising receiving output data from a plurality of audio sensors arranged in one of a linear array, a planar array, a circular array, or a three-dimensional array within the enclosure, wherein the plurality of audio sensors includes the first and second audio sensors.

14. The method of claim 7, wherein the first and second audio sensors are disposed within a common plane with a third audio sensor, and wherein the second and third audio sensors are spaced from the first sensor by a first radial distance.

15. The method of claim 7, further comprising:

generating an audio file, the audio file comprising a first channel including the first output data, and a second channel including the second output data; and determining the acoustic characteristic of the first audio sensor and the acoustic characteristic of the second audio sensor using the audio file.

16. The method of claim 7, wherein the acoustic characteristic of the first audio sensor comprises at least one of a sensitivity and a total harmonic distortion; and the acoustic characteristic of the second audio sensor comprises the at least one of a sensitivity and a total harmonic distortion.

17. A system, comprising:

a substantially soundproof enclosure;

a processor; and memory associated with the processor, the memory storing instructions which, when executed by the processor, cause the processor to perform operations including:

generating a first test tone, at a first frequency, with an audio source disposed within the enclosure, receiving first output data from a first audio sensor disposed within the enclosure, the first output data including information about a parameter of the first test tone as determined by the first audio sensor;

receiving second output data from a second audio sensor disposed within the enclosure and spaced from the first audio sensor the second output data including information about the parameter of the first test tone as determined by the second audio sensor, determining an acoustic characteristic of the first audio sensor based at least in part on the first output data, determining an acoustic characteristic of the second audio sensor based at least in part on the second output data, determining a first difference between the acoustic characteristic of the first audio sensor and a reference value, determining a second difference between the acoustic characteristic of the second audio sensor and the reference value, determining that the first difference is within a predetermined range of the reference value, generating a compensation factor of the first audio sensor based at least in part on determining that the first difference is within the predetermined range and using the first output data.

18. The system of claim 17, wherein the operations further include:

generating a second test tone at a second frequency higher than the first frequency, receiving third output data from the first audio sensor, the third output data including information about a parameter of the second test tone as determined by the first audio sensor, receiving fourth output data from the second audio sensor, the fourth output data including information about the parameter of the second test tone as determined by the second audio sensor, determining the acoustic characteristic of the first audio sensor based at least in part on the first and third output data, and determining the acoustic characteristic of the second audio sensor based at least in part on the second and fourth output data.

19. The system of claim 17, wherein the first and second audio sensors are disposed in a common first plane, and the audio source is disposed in a second plane spaced from the first plane by a first distance.

20. The system of claim 17, wherein the operations further include:

generating an audio file, the audio file comprising a first channel including the first output data and a second channel including the second output data, and determining the acoustic characteristic of the first audio sensor and the acoustic characteristic of the second audio sensor using the audio file.

* * * * *